US011879451B2

(12) United States Patent
O'Shea et al.

(10) Patent No.: US 11,879,451 B2
(45) Date of Patent: Jan. 23, 2024

(54) ACTIVE HYDRAULIC RIPPLE CANCELLATION METHODS AND SYSTEMS

(71) Applicant: ClearMotion, Inc., Billerica, MA (US)

(72) Inventors: Colin Patrick O'Shea, Cambridge, MA (US); Clive Tucker, Charlestown, MA (US); Brian Alexander Selden, Concord, MA (US)

(73) Assignee: ClearMotion, Inc., Billerica, MA (US)

( * ) Notice: Subject to any disclaimer, the term of this patent is extended or adjusted under 35 U.S.C. 154(b) by 200 days.

(21) Appl. No.: 17/198,584

(22) Filed: Mar. 11, 2021

(65) Prior Publication Data

US 2021/0207597 A1 Jul. 8, 2021

Related U.S. Application Data

(63) Continuation of application No. 16/094,391, filed as application No. PCT/US2017/028203 on Apr. 18, 2017, now Pat. No. 10,954,935.

(Continued)

(51) Int. Cl.
*F04B 49/06* (2006.01)
*F04B 49/10* (2006.01)

(Continued)

(52) U.S. Cl.
CPC ..... *F04B 49/065* (2013.01); *F04B 49/103* (2013.01); *F04B 49/20* (2013.01);

(Continued)

(58) Field of Classification Search
CPC ..... F04B 49/20; F04B 49/065; F04B 2203/0207; F04B 2201/1202;

(Continued)

(56) References Cited

U.S. PATENT DOCUMENTS 4,808,077 A 2/1989 Kan et al.
5,137,253 A * 8/1992 Frey ..... F01D 17/26 251/30.02

(Continued)

FOREIGN PATENT DOCUMENTS

JP H06-294375 A 10/1994
JP H11-002187 A 1/1999

(Continued)

OTHER PUBLICATIONS

U.S. Appl. No. 14/242,636, filed Apr. 1, 2014, O'Shea et al.

(Continued)

*Primary Examiner* — Peter J Bertheaud
(74) *Attorney, Agent, or Firm* — Wolf, Greenfield & Sacks, P.C.

(57) ABSTRACT

Presented herein are systems and methods for attenuating flow ripple generated by a hydraulic pump. In certain aspects, a method and system for operating a hydraulic positive displacement pump according to a stabilized command profile are disclosed, such that flow ripple generated by operation of the pump according to the stabilized command profile is attenuated as compared to operation of the pump according to a corresponding nominal command profile. In other aspects, a pressure-balanced active buffer is disclosed that allow for at least partially cancelling flow ripple in a hydraulic circuit comprising a pump. In another aspect, a method for generating ripple maps for a pump is disclosed. Such ripple maps may be used, for example, to determine the stabilized command profile used to operate the pump, or may be used by the pressure-balanced active buffer to counteract ripple in the hydraulic circuit.

14 Claims, 17 Drawing Sheets

Related U.S. Application Data

(60) Provisional application No. 62/378,397, filed on Aug. 23, 2016, provisional application No. 62/366,296, filed on Jul. 25, 2016, provisional application No. 62/360,938, filed on Jul. 11, 2016, provisional application No. 62/324,809, filed on Apr. 19, 2016.

(51) Int. Cl.
*F04B 49/20* (2006.01)
*F04C 28/08* (2006.01)

(52) U.S. Cl.
CPC ..... *F04B 2201/0201* (2013.01); *F04B 2201/0208* (2013.01); *F04B 2201/1202* (2013.01); *F04B 2201/1208* (2013.01); *F04B 2203/0207* (2013.01); *F04C 28/08* (2013.01)

(58) Field of Classification Search
CPC ..... F04B 2201/1208; F04B 49/103; F04B 2201/0201; F04B 2201/0208
See application file for complete search history.

(56) References Cited

U.S. PATENT DOCUMENTS

| | | | | |
|---|---|---|---|---|
| 5,492,451 | A | 2/1996 | Franz et al. | |
| 6,325,105 | B1 | 12/2001 | Rogers | |
| 6,491,065 | B1 | 12/2002 | Rogers | |
| 6,494,685 | B2 | 12/2002 | Carstensen | |
| 6,652,239 | B2 | 11/2003 | Carstensen | |
| 8,726,647 | B2 | 5/2014 | Peterson | |
| 8,776,961 | B2 | 7/2014 | Mori et al. | |
| 8,840,118 | B1 | 9/2014 | Giovanardi | |
| 9,174,508 | B2 * | 11/2015 | Anderson | B60G 17/016 |
| 9,550,404 | B2 | 1/2017 | Giovanardi | |
| 9,676,244 | B2 | 6/2017 | Giovanardi | |
| 9,702,349 | B2 | 7/2017 | Anderson | |
| 10,029,534 | B2 | 7/2018 | Giovanardi | |
| 10,954,935 | B2 | 3/2021 | O'Shea et al. | |
| 2008/0240932 | A1 | 10/2008 | Carstensen | |
| 2008/0275661 | A1 | 11/2008 | Yang et al. | |
| 2009/0260935 | A1 | 10/2009 | Avadhany et al. | |
| 2010/0072760 | A1 | 3/2010 | Anderson et al. | |
| 2010/0262308 | A1 | 10/2010 | Anderson et al. | |
| 2013/0205763 | A1 | 8/2013 | Caldwell et al. | |
| 2014/0119966 | A1 | 5/2014 | Stavale et al. | |
| 2014/0216081 | A1 | 8/2014 | West et al. | |
| 2014/0260233 | A1 | 9/2014 | Giovanardi et al. | |
| 2014/0265168 | A1 | 9/2014 | Giovanardi et al. | |
| 2014/0294601 | A1 | 10/2014 | O'Shea et al. | |
| 2015/0240812 | A1 | 8/2015 | Kemnitz | |
| 2019/0162179 | A1 | 5/2019 | O'Shea et al. | |
| 2021/0207597 | A1 | 7/2021 | O'Shea et al. | |

FOREIGN PATENT DOCUMENTS

| | | | |
|---|---|---|---|
| PL | 165 398 | B1 | 12/1994 |
| WO | WO 2007/067359 | A2 | 6/2007 |
| WO | WO 2011/159874 | A2 | 12/2011 |
| WO | WO 2014/145018 | A2 | 9/2014 |

OTHER PUBLICATIONS

U.S. Appl. No. 16/094,391, filed Oct. 17, 2018, O'Shea et al.
U.S. Appl. No. 17/251,571, filed Dec. 11, 2020, Belter et al.
PCT/US2017/028203, Sep. 25, 2017, International Search Report and Written Opinion.
International Search Report and Written Opinion dated Sep. 25, 2017 in connection with International Application No. PCT/US2017/028203.
Minav, Axial piston pump flow ripple compensation by adjusting the pump speed with an electric drive. The twelfth Scandinavian International Conference on Fluid P5b4ower, May 18-20, 2011. Tampere, Finland.

* cited by examiner

ACTIVE HYDRAULIC RIPPLE CANCELLATION METHODS AND SYSTEMS

CROSS-REFERENCE TO RELATED APPLICATIONS

This application is a Continuation of U.S. application Ser. No. 16/094,391, filed Oct. 17, 2018, which is a national stage filing under 35 U.S.C. § 371 of International Patent Application Serial No. PCT/US2017/028203, filed Apr. 18, 2017, which claims the benefit under 35 U.S.C. § 119(e) of U.S. provisional application Ser. No. 62/324,809, filed Apr. 19, 2016, U.S. provisional application Ser. No. 62/360,938, filed Jul. 11, 2016, U.S. provisional application Ser. No. 62/366,296, filed Jul. 25, 2016, and U.S. provisional application Ser. No. 62/378,397, filed Aug. 23, 2016, the disclosures of each of which are incorporated by reference in their entirety.

FIELD

Disclosed embodiments are related to hydraulic ripple cancelation methods and systems.

BACKGROUND

Hydraulic systems are employed in a wide variety of industrial and consumer applications. Many hydraulic systems make use of one or more pumps. Hydraulic pumps inherently generate flow ripple during operation. Flow ripple describes the behavior of positive displacement hydraulic pumps to output pulsations of fluid flow rather than a constant rate of fluid flow during operation at constant speed. This flow ripple may result in oscillations in operating pressure, referred to as pressure ripple, observed at one or more points in the hydraulic system. For industrial and commercial applications, flow ripple and/or the resulting pressure ripple may be associated with consequences such as premature failure of equipment or degradation in customer experience.

SUMMARY

Positive displacement pumps do not input/output a constant flow of fluid volume, even when spinning at constant speed, but instead produce pulsations of fluid flow. This phenomenon is known in the art as flow ripple and may be associated with a variety of undesirable consequences. Presented herein are various systems and methods for attenuating flow ripple and/or a resulting pressure ripple generated by operation of a hydraulic pump.

The inventors have recognized that various characteristics (e.g., magnitude, direction, frequency) of flow ripple generated by operation of a given pump may be related, in part, to a variety of parameters such as, for example, compressibility of a hydraulic fluid being pumped, overall system compliance, a torque applied to the pump, and, notably, leakage characteristics of the pump.

In one aspect, a method for operating a positive displacement pump is disclosed, the method comprising: (a) detecting a position of at least one of the positive displacement pump and a rotor of a motor operatively coupled to the positive displacement pump; (b) accessing a ripple map; (c) determining, based at least in part on the position and the ripple map, a stabilized command profile; (d) operating an active component according to the stabilized command profile, wherein the stabilized command profile corresponds to one of a stabilized command velocity profile and a stabilized command torque profile, and wherein the active component is at least one of the rotor and the positive displacement pump. Optionally, the method may further comprise obtaining a nominal command profile, wherein the nominal command profile is one of a nominal command torque profile and a nominal command velocity profile; determining, based at least in part on the position and the ripple map, a ripple cancellation profile, wherein the ripple cancellation profile is one of a ripple cancellation torque profile and a ripple cancellation velocity profile; and combining (e.g., adding, overlaying) the nominal command profile and the ripple cancellation profile to determine the stabilized command profile. Alternatively or additionally operating at least one of the rotor and the positive displacement pump according to the stabilized command profile may comprise: determining, based on the stabilized command torque profile, an electrical signal; applying an electric signal to the motor, wherein application of the electric signal to the motor causes the active component to operate according to the stabilized command profile. In certain embodiments, the ripple map is a flow ripple map (e.g., a leakage ripple map (e.g., a leakage gain map, a leakage coefficient map), a displacement ripple map (e.g., a displacement volume gain map)). In certain embodiments, the flow ripple map comprises a first plurality of values for a flow parameter (e.g., in the form of a table). In certain embodiments, each value for the flow parameter of the first plurality of values corresponds to a reference angular position.

In certain embodiments, the method further comprises, prior to step (b): detecting an operating condition (e.g., at least one of: a speed of the positive displacement pump, an ambient temperature, a temperature of hydraulic fluid at one or more points in a hydraulic circuit comprising the positive displacement pump, a direction of the positive displacement pump); and selecting the ripple map from a plurality of ripple maps based at least in part on the detected operating condition. In some of these embodiments, each ripple map of the plurality is associated with a reference operating condition, and selecting the ripple map from a plurality of ripple maps comprises: identifying a first reference operating condition that is equal to the detected operating condition; and selecting the ripple map associated with the first reference operating condition. Alternatively, in some embodiments each ripple map of the plurality is associated with a range of reference operating conditions, and selecting the ripple map from a plurality of ripple maps comprises: identifying a first range of reference operating conditions, the first range encompassing the detected operating condition; and selecting the ripple map associated with the first range of reference operating conditions. Alternatively, in some embodiments, each ripple map of the plurality is associated with a reference operating condition, and selecting the ripple map from a plurality of ripple maps comprises: identifying a first reference operating condition, wherein the first reference operating condition is most similar, as compared to any other reference operating condition associated with any ripple map of the plurality, to the detected operating condition; and selecting the ripple map associated with the first reference operating condition.

In another aspect, a hydraulic device (e.g., a hydraulic pump, a hydraulic motor-pump) is disclosed comprising: a positive displacement pump comprising one or more rotatable elements; a motor comprising a rotor operatively coupled to at least one of the one or more rotatable elements; a motor controller in communication with the motor; a computer readable memory in communication with the motor controller, the memory storing one or more ripple maps (e.g., flow ripple maps (e.g., leakage ripple maps (e.g., leakage gain maps (e.g., a table comprising a plurality of leakage gain values), leakage coefficient maps, leakage flow maps, leakage flow ripple maps), displacement ripple maps (e.g., displacement volume gain maps (e.g., a table comprising a plurality of displacement volume gain values), displacement volume maps)). In certain embodiments, the memory stores a set of instructions which, when executed by the motor controller, causes the motor controller to: detect a position of at least one of the positive displacement pump and a rotor of a motor operatively coupled to the positive displacement pump; access at least one of the one or more ripple maps; determine, based at least in part on the position and the at least one ripple map, a ripple cancellation profile, wherein the ripple cancellation profile is one of a ripple cancellation torque profile and a ripple cancellation velocity profile. Additionally, in some embodiments the set of instructions may cause the motor controller to: obtain a nominal command profile; determine, based on the ripple cancellation profile and the nominal command profile, a stabilized command profile; and operate an active component according to the stabilized command profile, wherein the nominal command profile corresponds to one of a nominal command velocity profile and a nominal command torque profile, wherein the stabilized command profile corresponds to one of a stabilized command velocity profile and a stabilized command torque profile, and wherein the active component is at least one of (i) the rotor and (ii) at least one of the one or more rotatable elements of the positive displacement pump.

In another aspect, a method for generative a ripple map (e.g., a pressure ripple map, a flow ripple map (e.g., leakage ripple maps (e.g., leakage gain maps (e.g., a table comprising a plurality of leakage gain values), leakage coefficient maps, leakage flow maps, leakage flow ripple maps), displacement ripple maps (e.g., displacement volume gain maps (e.g., a table comprising a plurality of displacement volume gain values), displacement volume maps)) is disclosed, the method comprising: (a) pressurizing a first chamber in fluid communication with a first port of the positive displacement pump and a second chamber in fluid communication with a second port of the positive displacement pump to an elevated pressure (e.g., at least 2 psig, at least 100 psig, at least 20 psig, at least 250 psig, at least 300 psig, at least 400 psig, at least 500 psig, less than 10000 psig, less than 1000 psig); (b) applying a first torque to the positive displacement pump; (c) maintaining the first torque for a duration of time; (d) while maintaining the first torque: detecting a first pressure of the first chamber at a first point in time; detecting a first position of the pump at the first point in time; detecting a second pressure of the first chamber at a second point in time; detecting a second position of the pump at the second point in time; and (e) generating a ripple map based at least in part on the first pressure, the second pressure, the first position, and the second position. In certain embodiments, the method further comprises: determining an average speed of the positive displacement pump over the duration of time; and generating the ripple map based at least in part on the average speed. In certain embodiments, the method further comprises: following step (a) and prior to steps (b)-(e), closing a valve located along at least one of: (i) a first external flow path in fluid communication with the first chamber and (ii) a second external flow path in fluid communication with the second chamber, such that following closing the valve a hydraulic circuit is formed consisting essentially of the positive displacement pump, the first chamber, the second chamber, one or more valves, and one or more sensors. Alternatively, in certain embodiments the method comprises: following step (a) and prior to steps (b)-(e), closing a valve located along a selected flow path, such that following closing the valve a hydraulic circuit is formed consisting essentially of the pump, the first chamber, the second chamber, one or more sensors, one or more valves, and one or more hydraulic accumulators, and wherein the selected flow path is least one of: (i) a first external flow path in fluid communication with the first chamber and (ii) a second external flow path in fluid communication with the second chamber.

Additionally or alternatively, in certain embodiments the method comprises: applying a second torque (e.g., a second torque having a direction opposite that of the first torque) to the positive displacement pump, the second torque having a magnitude different than that of the first torque; while maintaining the second torque: (i) detecting a third pressure of the first chamber at a third point in time; (ii) detecting a third position of the pump at the third point in time; (iii) detecting a fourth pressure of the first chamber at a fourth point in time; (iv) detecting a fourth position of the pump at the fourth point in time; and generating a second ripple map based at least in part on the third pressure, the fourth pressure, the third position, and the fourth position.

In yet another aspect, a pressure-balanced active buffer for mitigating flow ripple is disclosed, the pressure-balanced active buffer comprising: a buffer reservoir; a balance reservoir; a piston assembly comprising a first surface exposed to fluid in the buffer reservoir and a second surface exposed to fluid in the balance reservoir; an actuator (e.g., a piezoelectric actuator (e.g., a piezoelectric stack)) physically attached to the piston assembly. In certain embodiments, the piston assembly comprises: a buffer piston comprising the first surface; a balance piston comprising the second surface; and an intermediate chamber interposed between the buffer piston and the balance piston, wherein the intermediate chamber comprises a compressible fluid, and wherein the actuator is physically attached to the buffer piston. Additionally, in some embodiments the pressure-balanced active buffer may comprise a buffer fluid channel in fluid communication with the buffer reservoir and a balance fluid channel in fluid communication with the balance reservoir.

Additionally or alternatively, the pressure-balanced active buffer may comprise an actuator controller in communication with the actuator and configured to determine an actuator cancellation signal based at least in part on a first set of inputs, wherein transmitting the actuator cancellation signal to the actuator causes a dimension of the actuator to change. In certain embodiments, the actuator controller may be in communication with a non-transitory computer memory storing at least one ripple map. In certain embodiments, the pressure-balanced active buffer may further comprise a positive displacement pump comprising an outlet port, wherein the outlet port is in fluid communication with the buffer reservoir and the balance reservoir, a motor comprising a rotor operatively coupled to one or more rotatable elements of the positive displacement pump, and/or a rotary position sensor configured to generate a position signal corresponding to an angular position of at least one of: (i) the positive displacement pump and (ii) the rotor, wherein the first set of inputs comprises the position signal. 57. In certain embodiments, the pressure-balanced active buffer may comprise a plurality of actuators (e.g., piezoelectric actuators (e.g., piezoelectric stacks)) physically attached to the buffer piston.

In yet another embodiment, a method for operating a pressure-balanced active buffer is disclosed, the method comprising: receiving, at the buffer reservoir, a first portion of fluid from a hydraulic circuit; receiving, at the balance reservoir, a second portion of fluid from the hydraulic circuit, wherein the first surface is exposed to the first portion of fluid and the second surface is exposed to the second portion of fluid; changing a position of the first surface, thereby changing a volume of the buffer reservoir. In certain embodiments, changing the position of the first surface comprises changing a dimension of an actuator (e.g., a piezoelectric actuator (e.g., a piezoelectric stack)) physically attached to a buffer piston, wherein the buffer piston comprises the first surface. In certain embodiments, the method comprises determining (e.g., by an actuator controller) a cancellation signal; and applying the cancellation signal (e.g., an electrical signal (e.g., an electrical voltage)) to the actuator physically attached to a buffer piston comprising the first surface, wherein applying the cancellation signal to the actuator changes a dimension of the actuator, thereby changing the position of the first surface.

In certain embodiments, determining the cancellation signal comprises: characterizing a first aspect of a ripple at a first point in a hydraulic circuit; determining, based at least in part on the characterized magnitude, the cancellation signal, wherein the aspect is at least one of a direction and a magnitude, and wherein the ripple is at least one of a flow ripple and a pressure ripple. In some embodiments, changing the volume of the buffer reservoir results in a second magnitude of a ripple at a second point in the hydraulic circuit being lower than a first magnitude of the ripple at a first point in the hydraulic circuit, wherein the ripple is at least one of a flow ripple and a pressure ripple. In certain embodiments, characterizing the aspect comprises: detecting (e.g., by a position sensor) an angular position of at least one of: (i) the positive displacement pump and (ii) a rotor of a motor operatively coupled to one or more rotatable elements of the positive displacement pump; and determining the aspect based at least in part on the determined position. In certain embodiments, determining the aspect may comprise accessing a ripple map and determining the aspect based at least in part on the detected position and the ripple map.

It should be appreciated that the foregoing concepts, and additional concepts discussed below, may be arranged in any suitable combination, as the present disclosure is not limited in this respect. It is envisioned that any feature of any embodiment may be combined with any other feature of any other embodiment. Further, other advantages and novel features of the present disclosure will become apparent from the following detailed description of various non-limiting embodiments when considered in conjunction with the accompanying figures. Further, it should be understood that the various features illustrated or described in connection with the different exemplary embodiments described herein may be combined with features of other embodiments or aspects. Such combinations are intended to be included within the scope of the present disclosure.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, identical or nearly identical components illustrated in the various figures may be represented by a like numeral. For purposes of clarity, not every component may be labeled in every drawing.

DETAILED DESCRIPTION

A glossary of terms used in this disclosure is included at the end of this section.

As discussed in further detail herein, hydraulic pumps in general and especially positive displacement pumps commonly do not discharge a constant stream of fluid, but rather discharge fluid in a pulsating manner. These flow pulsations are known as flow ripple. Flow ripple may cause pressures pulsations that may be observed at various points in a hydraulic system, leading to increased noise and/or instability of the hydraulic system. In one aspect, methods and systems for mitigating flow ripple at its source (e.g., at the pump) are described. For example, the inventors have recognized that carefully and rapidly controlling a torque applied to the pump during operation of the pump may decrease a magnitude of flow ripple observed at a discharge port, inlet port of the pump or throughout the hydraulic system or circuit. Such control may be achieved using a feed forward model that characterizes various parameters that contribute to flow ripple based on a variety of inputs. The feed forward model may, in certain embodiments, access one or more maps and/or rules that may be obtained using empirical data.

In another aspect, systems and methods for empirically obtaining data related to flow ripple and developing maps using the empirically obtained data are described. These maps may be utilized, for example, in the aforementioned feed-forward model to characterize parameters related to flow ripple.

In yet another aspect, a pressure balanced active buffer is described which partially counteracts or cancels flow ripple at one or more points in a hydraulic system after said flow ripple is generated by the pump. In certain embodiments, the active buffer operates by alternatively introducing fluid into, and receiving fluid from, a hydraulic circuit comprising the pump and the pressure balanced active buffer. Advantageously, in certain embodiments the active buffer is pressure balanced as described herein.

Figure 1:
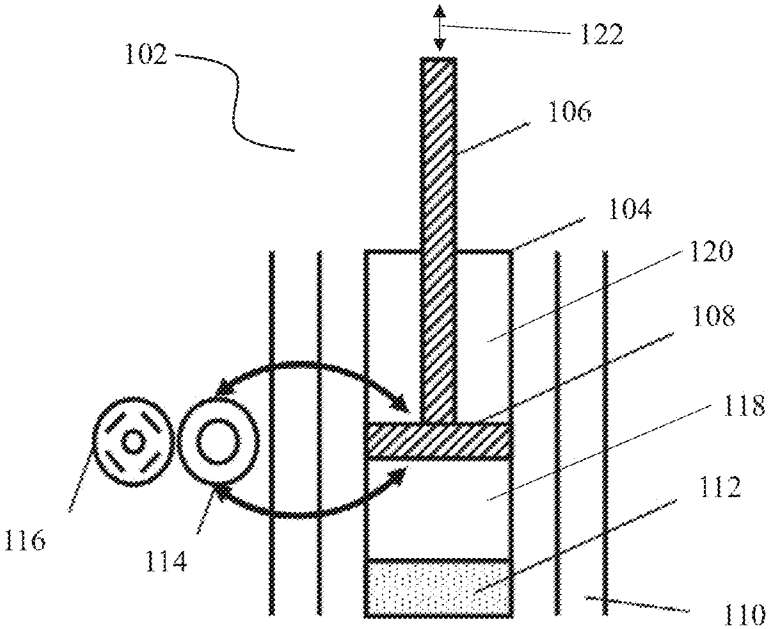
FIG. 1 illustrates an embodiment of a hydraulic system comprising an electro-hydraulic actuator.

Turning now to the figures, several non-limiting embodiments are now described in detail. Hydraulic pumps are used in a wide variety of systems. For example, a hydraulic pump may be a component of an electro-hydraulic actuator, an embodiment of which is shown in FIG. 1. According to the illustrated embodiment of FIG. 1, the actuator 102 includes a bidirectional motor-pump 114 (referred to herein as a pump), which may be a hydraulic pump or a hydraulic motor that may be operated as a hydraulic pump and/or as a hydraulic motor, operatively coupled to a bidirectional motor-generator 116 (referred to herein as a motor) which may be an electric motor or an electric generator that may be operated as an electric motor. The pump may be in fluid communication with a compression chamber 118 via a first port and a rebound chamber (also referred to as an extension chamber) 120 via a second port. The compression chamber 118 and extension chamber 120 may be separated by a piston 108 slidably received in a housing 104 which may be cylindrical. In the illustrated embodiment, controlling electric power that is supplied to the motor 116 may drive the pump 114 and may result in elevation of fluid pressure in one of the chambers (e.g. the compression chamber 118) relative to the other chamber (e.g., the extension chamber 120), thereby applying a controlled net active force to the piston 108. The electro-hydraulic actuator 102 may also operate in passive mode, to apply a resistive damping force opposite to the direction of motion of the piston 108. An active force is a force that is applied to a body in the direction of the motion of the application point. A resistive force is a force that is applied to a body in a direction opposite the direction of the motion of the application point.

Figure 2:
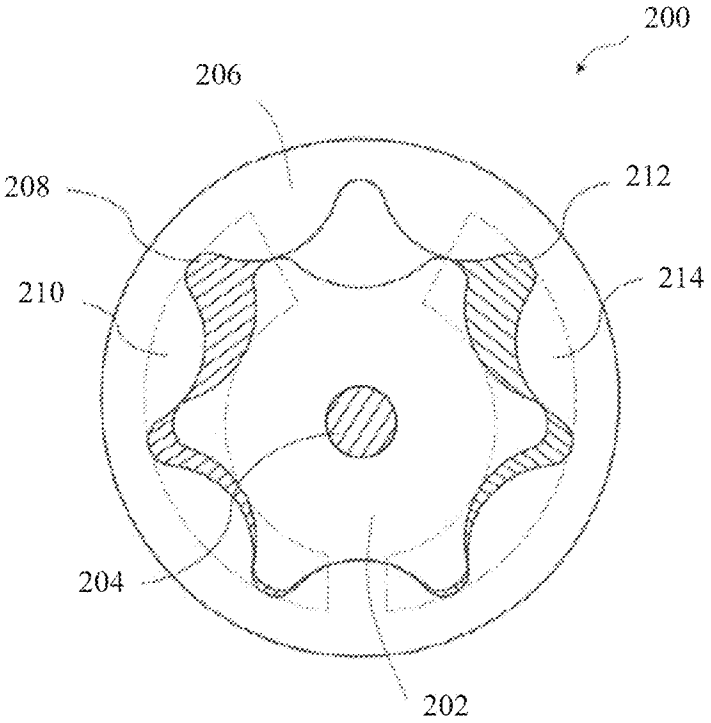
FIG. 2 illustrates an embodiment of an aspect of a positive displacement pump.

In certain embodiments, a pump 114 may be a positive displacement hydraulic pump. Such pumps typically operate by receiving a quantity of hydraulic fluid during an intake process in an enclosed volume, trapping the fluid quantity in an enclosed volume, and then compressing that volume to force the liquid out from an exhaust port at a pressure, if the device is operating as a pump) that is higher than an intake pressure. For example, in certain embodiments, the pump 114 may be a gerotor, an embodiment of which is shown in FIG. 2. FIG. 2 illustrates aspect of an embodiment of a gerotor hydraulic pump/motor 200 with a shaft driven six tooth inner gear 202 that engages a seven tooth outer gear 206. Also, shown by dashed lines are a first axial flow port 210 and a second axial flow port 214. Since gerotor pumps may be bi-directional, either of the axial flow ports may act as an intake port or an exhaust port depending on the direction of operation. If the first axial flow port 210 is used as an intake port, a first cross hatched volume 208 is filled with liquid from the first axial flow port 210 as the gears 202 rotate in the clockwise (CW) direction. Simultaneously the liquid in a second cross hatched volume 212 is forced out of the second axial flow port 214 as the teeth of the inner gear 202 and outer gear 206 mesh together, thereby causing the trapped volume between the teeth to contract. Eventually the liquid in the first cross hatched volume 208 is transported to the second axial flow port 214 by the rotation of the gears 202 and 206 and the process is repeated. In the case of a bidirectional pump, the inner gear 202 and outer gear 206 may alternatively rotate in the opposite direction (e.g., counterclockwise (CCW)), in which case, for the illustrated embodiment, the second axial flow port 214 acts as the intake port while the first axial flow port 210 acts as the discharge port.

As is known in the art, due to the geometric considerations, the rate of contraction or expansion of the trapped volumes between the inner gear 202 and outer gear 206 varies even when the gears are rotating at a constant angular speed. Therefore, the flow rate of fluid discharged at a port that functions as an exhaust port may fluctuate at a fundamental frequency equal to the number of teeth on the inner gear multiplied by the rotational speed of the inner gear (or a shaft operatively coupled to the gear) or to the number of teeth on the outer gear multiplied by the rotational speed of the outer gear. Returning now to FIG. 1, the aforementioned fluctuations in discharge flow rate (referred to herein as "flow ripple") may result in fluctuations in observed pressure differential between the compression chamber 118 and the extension chamber 120. These fluctuations in pressure differential, which may also be referred to as "pressure ripple," may, in turn, result in variations in force exerted on the piston 108. These variations in force may be referred to as "force ripple". As used herein, the term ripple may refer to flow ripple, pressure ripple, or force ripple, as all aforementioned phenomena may be interrelated and share a common origin (during operation of a hydraulic pump). Additionally, ripple may generate audible noise or other instability in a hydraulic system.

During operation of the electro-hydraulic actuator 102 shown in FIG. 1, in certain embodiments it may be desirable to operate the electro-hydraulic actuator 102 such that a specified force is exerted on the piston 108, thereby causing the piston 108 and piston rod 106 to accelerate in an axial direction 122. In order to exert a specified force on the piston 108, a desired pressure differential between the extension chamber 120 and compression chamber 118 may be determined using methods known in the art, such that applying the desired pressure differential across the piston 108 produces the specified force on the piston 108. For example, the equations $F=PcAc-PrAr$ and $\Delta P=Pc-Pr$ may be used, where F is the specified force to exert on the piston 108, Ac is the cross sectional area of the piston exposed to fluid in the compression chamber 118, Ar is the cross sectional area of the piston exposed to fluid in the extension chamber 120, Pc is pressure of the compression chamber, Pr is pressure of the extension chamber, and $\Delta P$ is the pressure differential across the piston.

In certain embodiments, in order to generate a desired pressure differential across the piston, a torque may be applied to the pump 114 (specifically, to one or more rotatable elements of the pump 114) by the motor 116. As would be understood by one of ordinary skill in the art, an applied torque necessary to achieve a given pressure differential may be directly related to the given pressure differential and a displacement volume of the pump 114. For example, the equation $\tau=J\dot{\omega}+\tau_{drag}+\Delta P\cdot Disp_g$ may be used, where $\tau$ is the applied torque necessary to achieve the desired pressure differential $\Delta P$ across the piston. J is the moment of inertia of the pump, $\tau_{drag}$ represents drag torque, $Displ_g$ is the displacement volume of the pump. For a low-inertia pump operating under low drag conditions, the first two terms may be disregarded such that the equation $\tau=\Delta P\cdot Disp_g$ may be used to acceptably approximate the applied torque necessary to achieve the desired pressure differential $\Delta P$. As would be recognized by one of skill in the art, other parameters, depending on specific pump and system design, may also be considered in determining the desired pressure differential across the piston 108 and/or desired applied torque on the pump 114 based on a specified force on the piston 108.

As described above, the magnitude and direction of an instantaneous force exerted on the piston 108 is therefore related to an instantaneous pressure differential between the compression chamber 118 and the extension chamber 120, which in turn is related to a torque applied to an active element (e.g., a shaft, an internal gear, an external gear, a rotor) of the pump 114 by the motor 116. In order to precisely control the force applied to the piston, in certain embodiments a motor controller (not pictured) in communication with the motor 116 may be utilized. As would be recognized by one of ordinary skill in the art, a motor controller may include one or more processors, associated software code, and/or electronic circuitry to vary operation (e.g., torque, angular speed) of the electric motor as a function of one or more input signals. In certain embodiments, the motor controller may operate by varying an amount of electrical power (e.g., a voltage, a current) applied to the motor based on the one or more input signals.

In certain embodiments, the motor controller may receive (from, for example, an external controller or user) a "nominal command torque" value or profile as an input parameter, and may apply a signal to the motor 116 such that the motor applies a torque to the pump (e.g., a shaft of the pump) equal to the nominal command torque value or profile. Alternatively, the motor controller may receive (from, for example, an external controller or user) a "nominal command pressure differential" value or profile as an input parameter, and may determine the nominal command torque value or profile using, for example, the aforementioned equations relating pressure differential to applied torque. Alternatively or additionally, the motor controller may receive (from, for example, an external controller or user) a "nominal command force" value or profile, and may determine the nominal command torque value or profile using, for example, the aforementioned equations relating force to pressure differential and applied torque.

Figure 3:
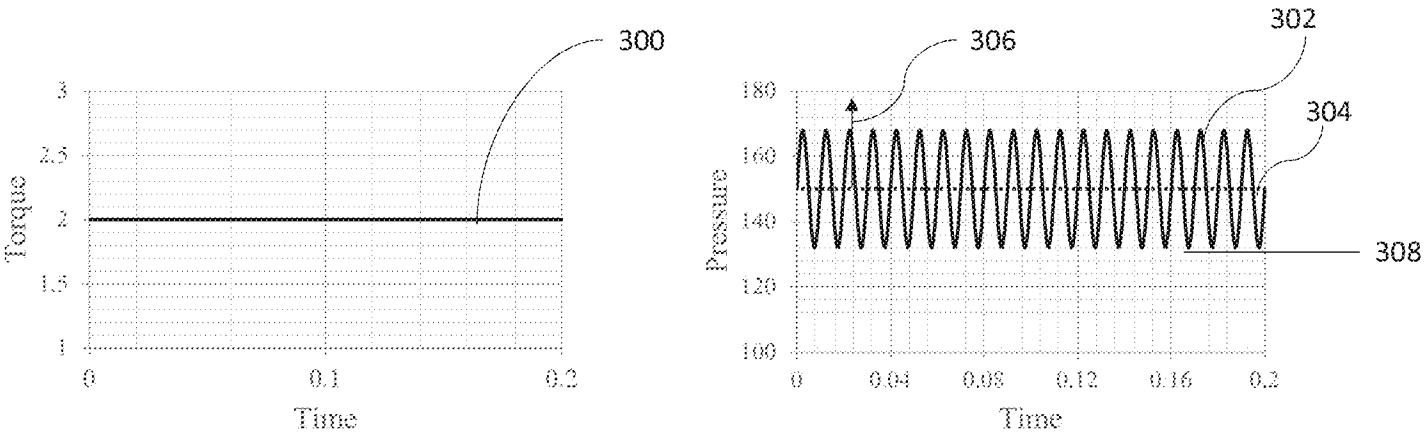
FIG. 3 illustrates an embodiment of a time constant torque profile and a resulting time varying pressure differential profile as a function of time.

Due to flow ripple, application of constant torque over a given period of time may result in periodic variations in instantaneous pressure differential over that period, as shown in FIG. 3. As can be seen in FIG. 3, application of a constant torque 300 of 2 N-m to a given pump results in a nominal pressure differential 304 (shown by a dashed line) of approximately 150 psi. Due to pressure ripple, actual observed total pressure differential 302 varies according to a sum of a periodic waveform with an amplitude 306 of approximately 40 psi added to the nominal differential pressure 304. Specifically, at a time of 0.04 seconds 3-110 the instantaneous pressure differential 308 is approximately 138 psi. The magnitude of pressure ripple at a time of 0.04 seconds 3-110 is therefore 12 psi (i.e., the absolute value of the difference between the nominal pressure differential 304 of 150 psi and the instantaneous pressure differential at 0.04 seconds 3-110 of 138 psi). The direction of pressure ripple at a time of 0.04 seconds is said to be negative since the instantaneous pressure differential at 0.04 seconds 3-110 of 138 psi minus the nominal pressure differential 3-103 of 150 psi yields a negative number.

In some embodiments, the frequency of pressure ripple or flow ripple of a pump may be in a range with a lower limit and an upper limit. In certain embodiments, the lower limit may be 0 Hz, 100 Hz, 200 Hz, 300 Hz, 400 Hz, 500 Hz, 600 Hz, 700 Hz, 800 Hz, 900 Hz, 1000 Hz, 1100 Hz, 1200 Hz, 1300 Hz, or 1400 Hz. In certain embodiments, the upper limit may be 100 Hz, 200 Hz, 300 Hz, 400 Hz, 500 Hz, 600 Hz, 700 Hz, 800 Hz, 900 Hz, 1000 Hz, 1100 Hz, 1200 Hz, 1300 Hz, 1400 Hz, or 1500 Hz. Combinations of the above ranges are contemplated including, for example, a lower limit of 0 Hz and an upper limit of 1500 Hz. However, other combinations and frequencies both greater and less than those noted above may also be used as the disclosure is not so limited.

In certain hydraulic systems or applications, rather than applying a constant torque 300 to the pump over a given period of time, a torque a fluctuating profile may be applied over that period. However, the applied torque may be modulated as a function of time.

Figure 5:
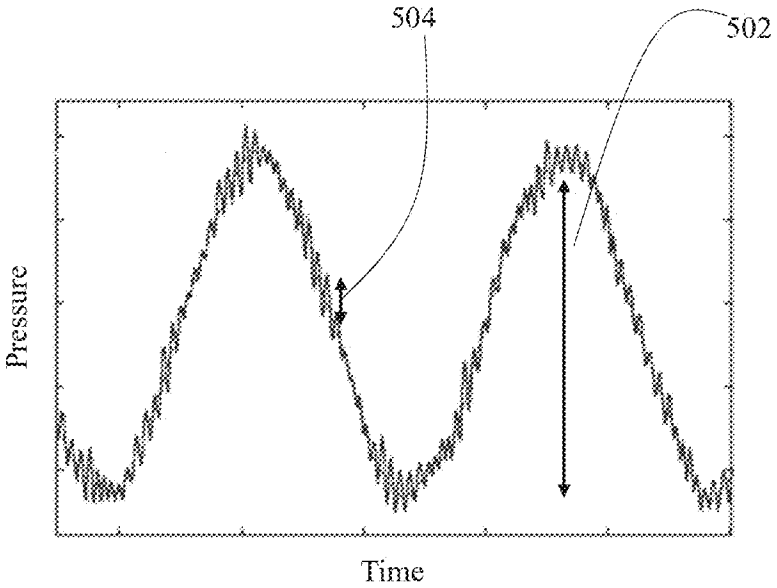
FIG. 5 illustrates an embodiment of an observed pressure differential profile.
Figure 4:
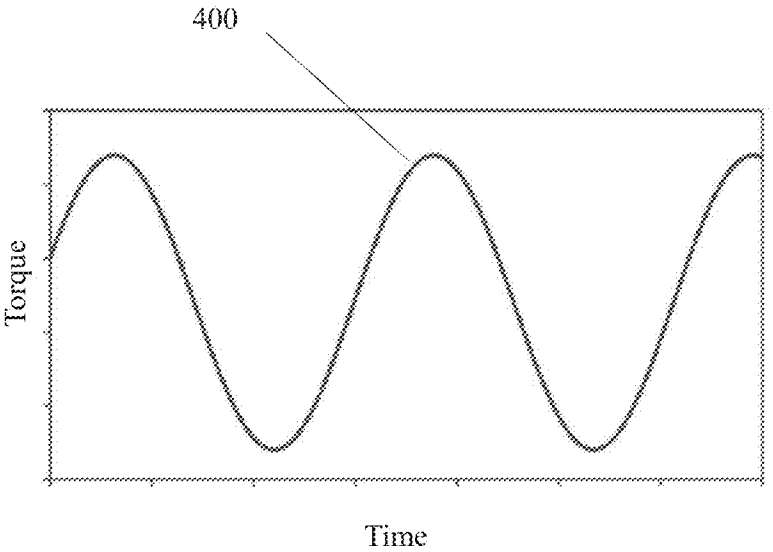
FIG. 4 illustrates an embodiment of a time varying torque profile

FIG. 4 illustrates an applied nominal torque profile in which the applied torque 400 is periodically modulated at a given frequency as a function of time. Periodically modulating the applied torque as shown in FIG. 4 may result in an observed pressure differential profile as shown in FIG. 5. As can be seen in FIG. 5, the observed pressure differential profile includes both (a) low frequency, high amplitude nominal variations 502 with a frequency and amplitude corresponding to the frequency and amplitude of the applied torque profile; and (b) a superimposed high frequency, low amplitude variations 504 that arise due to flow ripple. The low frequency variations 502 correspond to the nominal pressure differential profile, while the high frequency variations 504 correspond to pressure ripple and depend at least partially on the structure and operating speed of the pump.

Development of a Feed-Forward Model of Ripple

The inventors have recognized that flow ripple and resulting pressure ripple may result in acoustic noise and/or instability in hydraulic systems. In order to counteract effects of flow ripple and/or a resulting pressure ripple 504 generated by a hydraulic pump, in certain embodiments, active mitigation methods may be employed. Active mitigation methods, several of which are described in detail herein, encompass methods in which a cancellation signal is determined by one or more controllers, and the cancellation signal is then actively applied to a component of the hydraulic system to partially or fully mitigate an effect of flow and/or pressure ripple.

In order to determine an appropriate cancellation signal to apply at a given time, instantaneous ripple (e.g., flow ripple or pressure ripple at the given time) may be characterized. The term "characterizing", when used in relation to characterizing ripple or an aspect (e.g., frequency, direction, magnitude) of ripple, is understood to encompass, for example, measuring, detecting, predicting, or approximating. The controller may utilize a closed-loop control system (e.g., a feedback based system) and/or an open-loop control system to characterize the ripple. In a closed loop ripple control system (feedback based system), instantaneous values for flow ripple and/or pressure ripple may be determined using one or more sensors that directly detect variations in flow or pressure, and detected values for flow ripple and/or pressure ripple may be "fed back" into the controller as input parameters. The cancellation signal determined by the controller is therefore based on directly detected ripple values. In an open-loop control system, a feed forward model may be utilized to predict or approximate flow ripple and/or pressure ripple using a variety of inputs without directly measuring instantaneous flow ripple and/or pressure ripple.

Closed-loop control systems may be desirable in certain embodiments as they require less a priori knowledge during design. However, as frequency of flow ripple and/or pressure ripple is related to a velocity of the pump, at high pump velocities it may be impractical to perform closed-loop control on the pump due to limitations such as, for example, time-resolution limits of sensors and/or limited processing capability of the controller(s). An open-loop control system utilizing a feed forward model may therefore be desirable in certain applications, especially those in which high pump velocities are possible.

Figure 6:
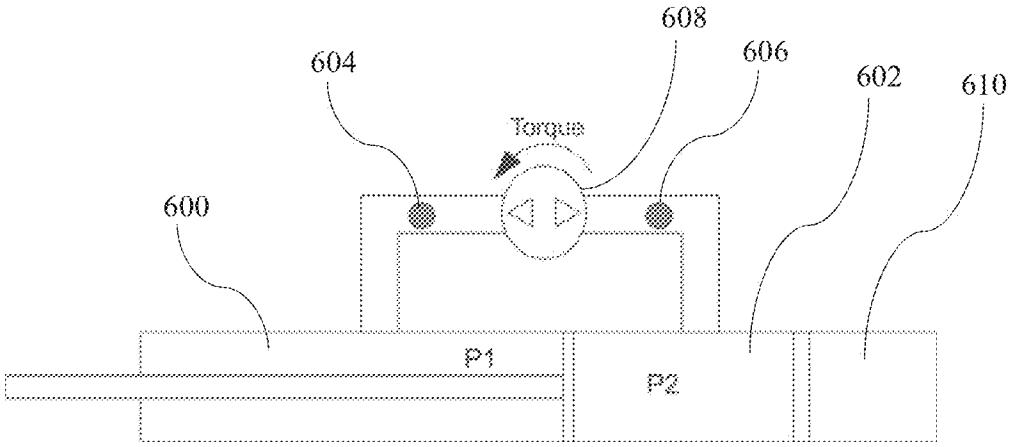
FIG. 6 illustrates an embodiment of a hydraulic system comprising an electro-hydraulic actuator.

Development of an open-loop control system may require analysis and understanding of fluid transport in a given hydraulic system, such as the simple hydraulic system shown in FIG. 6. FIG. 6 illustrates a schematic of a simple hydraulic actuator including a pump 25 located directly in the flow path between an extension chamber 600 and compression chamber 602 of the actuator. In the embodiment illustrated in FIG. 6, an accumulator 610 is included to accept the rod volume of the actuator during compression. A first flow node 604 and second flow node 606 are considered on either side of the hydraulic pump 608. In certain embodiments, the pump 608 may be a gear pump such as, for example, an internal gear pump (e.g., a gerotor). For the purposes of the following analysis, it is assumed that the pump 608 is a gerotor. However, the methods and systems described herein are envisioned as applicable to a variety of different types of positive displacement pumps, as the disclosure is not so limited as to a gerotor or any particular pump or hydraulic circuit.

In the hydraulic system illustrated in FIG. 6, there may be two transport methods for fluid to move from one side of the gerotor 608 to another. These two transport methods are referred to herein as displacement flow and leakage flow. Displacement flow describes fluid flow in which fluid travels through the gerotor as a direct result of rotation of the gears of the gerotor, while leakage flow describes fluid flow in which fluid bypasses gear rotation. Leakage flow generally occurs from a high pressure side of the pump to a low pressure side of the pump (i.e., opposite the pumping direction during active operation of the pump). Leakage flow may occur in a gerotor, for example, via flow through free volumes located between the outer gear 206 and a housing, or through free volumes that arise due to insufficient sealing between teeth of the inner gear 202 and teeth of the outer gear 206.

In order to determine instantaneous flow ripple, periodic variations (ripple) in both displacement flow and/or leakage flow may be considered. A feed-forward model capable of determining both instantaneous displacement flow and instantaneous leakage flow would potentially allow for active ripple cancellation in an open-loop control system.

Figure 8:
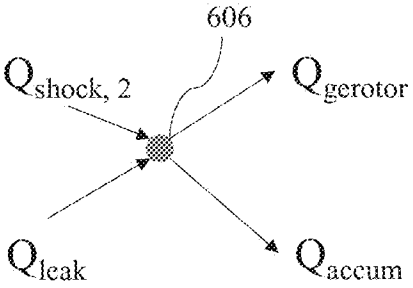
FIG. 8 illustrates a schematic of fluid flow at a second point in a hydraulic circuit.
Figure 7:
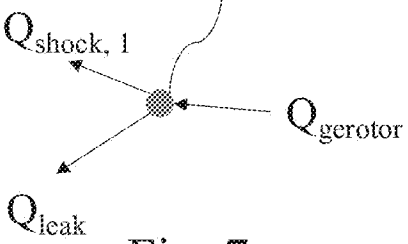
FIG. 7 illustrates a schematic of fluid flow at a first point in a hydraulic circuit.

While not wishing to be bound by theory, returning to FIG. 6, assuming application of counter clockwise (CCW) motor torque and CCW rotation and an incompressible fluid, application of the continuity equation to the first flow node 604 and second flow node 606 (shown schematically in FIG. 7 and FIG. 8) results in equations 1 and 2 given below. With this set of flow sources and flow sinks, the flow equation on each side of the gerotor 608 differs by only the accumulator flow, which is equivalent to the difference in actuator flow due to the insertion or removal of the rod volume. It is therefore reasonable to consider a single flow equation for the gerotor as the flow equation for the basis of a flow cancellation algorithm.

$$Q_{gerotor}=Q_{shock,1}+Q_{leak} \tag{1}$$

$$Q_{gerotor}=Q_{shock,2}+Q_{leak}-Q_{Accum} \tag{2}$$

In a theoretical steady state system in which flow ripple is perfectly cancelled, the position of the piston and piston rod remains constant such that there is no flow into the accumulator. It is, therefore, reasonable to consider the flow equation of equation 1 as the basis of a flow cancellation algorithm.

Displacement flow, denoted $Q_{disp}$, is proportional to the product of instantaneous gerotor speed, denoted co, and the displacement volume of the gerotor, denoted $Disp_g$.

$$Q_{disp}(\theta)=\omega\cdot Disp_g(\theta) \tag{3}$$

As discussed above, positive displacement pumps do not produce constant displacement. Rather, for a gerotor, the displacement volume, $Disp_g$, is a function of an angular position Θ of the gerotor (e.g, an angular position of the shaft of the gerotor), and is given by equation (4).

$$Disp_g(\theta) = \alpha\cdot\sin\left(\frac{2\pi\cdot n}{360}\theta+\varphi\right)+Disp_{g,mean} \tag{4}$$

As used above, the term φ is a phase offset parameter that relates a position of a position sensor to the angular position of the pump (specifically to the angular position of the shaft, internal gear, or external gear of the pump). For clarity of analysis, it is assumed that the offset parameter is zero for the remainder of this analysis, and it is therefore omitted in the proceeding equations. However, as would be recognized by one of ordinary skill in the art, the offset parameter φ may be included in the equations that follow, and may be determined for a given pump and motor combination may be determined by empirical calibration of the pump and motor. The periodic portion of equation (4), $$\alpha\cdot\sin\left(\frac{2\pi\cdot n}{360}\theta+\varphi\right),$$

may be referred to as displacement volume ripple, while the term $Disp_{g,mean}$ represents the nominal, or mean displacement volume.

Plugging equation 4 into equation 3 yields equation 5, which relates instantaneous displacement flow to angular position.

$$Q_{disp}(\theta) = \omega\cdot\alpha\cdot\sin\left(\frac{2\pi\cdot n}{360}\theta\right)+\omega\cdot Disp_{g,mean} \tag{5}$$

In equation 4, n represents the number of pumping elements (e.g., the number of teeth on the inner gear of the gerotor), a represents a displacement volume gain corresponding to the magnitude or amplitude of displacement flow ripple, and $Disp_{g,mean}$ represents a mean or nominal displacement. The value Dispg,mean may be determined empirically using methods known in the art (e.g., by measuring the total volume of fluid displaced by running the pump at a constant speed for a given time), or may be determined computationally via modelling (e.g., computational fluid dynamics) accounting for geometric parameters of the pump. The value a may be determined empirically as described in the following sections of the disclosure, or may be computed via modelling accounting for geometrical analysis (e.g., computational fluid dynamics) of the pump using methods known in the art. The variables ω and Θ may be sensed during pump operation by one or more position sensors (e.g., one or more hall effect sensors) integrated into either a rotating element of the pump, a shaft of the pump, and/or a rotor of a motor operatively coupled to the pump. As all parameters may be determined a priori or detected during use, equation 5 may be solved to determine an instantaneous displacement flow. A displacement flow ripple may then be determined by taking the difference of instantaneous displacement flow Qdisp and a mean or nominal displacement flow Qdisp,mean, as shown in equation 32.

$$Q_{disp,ripple}(\theta)=Q_{disp}(\theta)-Q_{disp,mean}(\theta) \tag{32}$$

As described previously, flow ripple may include both displacement flow ripple ($Q_{disp,ripple}$) and leakage flow ripple. Leakage flow, denoted $Q_{leak}$, is proportional to the product of the instantaneous pressure differential across the gerotor, denoted ΔP, and a leakage coefficient, denoted Clg, as shown in equation 6. Due to geometrical considerations, the leakage coefficient Clg is a function of angular position and is given by equation 7. Plugging equation 7 into equation 6 yields equation 8, which relates instantaneous leakage flow to angular position. As can be seen in equation 16, the leakage flow includes a periodic component of leakage (which represents leakage flow ripple), and a nominal, or mean, leakage flow.

$$Q_{leak}=\Delta P(\theta)\cdot Cl_a(\theta) \tag{6}$$

$$Cl_g(\theta)=\beta(\theta)\cdot\sin\left(\frac{2\pi\cdot n}{360}\theta+\gamma\right)+Cl_{g,mean} \tag{7}$$

$$Q_{leak}=\Delta P(\theta)\cdot\beta(\theta)\cdot\sin\left(\frac{2\pi\cdot n}{360}\theta\right)+\Delta P(\theta)\cdot Cl_{g,mean} \tag{8}$$

$$Q_{leak}=Q_{leak,ripple}(\theta)+Q_{leak,nominal} \tag{16}$$

$$Q_{leak,ripple}(\theta)=\Delta P(\theta)\cdot\beta(\theta)\cdot\sin\left(\frac{2\pi\cdot n}{360}\theta\right) \tag{17}$$

The parameter γ from equation 7 is an offset parameter that relates a position of a position sensor to the angular position of the pump (specifically to the angular position of the shaft, internal gear, or external gear of the pump). For clarity of analysis, it is assumed that the offset parameter is zero for the remainder of this analysis, and it is therefore omitted in the following equations. However, as would be recognized by one of ordinary skill in the art, the offset parameter for a given pump and motor combination may be included in the following equations, and may be determined by empirical calibration of the pump and motor.

In equation 8, β represents a leakage gain corresponding to the magnitude or amplitude of leakage flow ripple and $Cl_{g,mean}$ represents a time-averaged mean (or nominal) leakage coefficient. The inventors have recognized that p may be considered a function of Θ. As recognized by the inventors, due to manufacturing variations (tolerances), each gear tooth of a gerotor has slightly different dimensions, resulting in a leakage gain that depends on the angular position of the pump.

Equation 5 and equation 8 form the basis of a feed forward model that may be used to predict or approximate instantaneous flow ripple of a hydraulic system based on a variety of inputs. Equation 5 and equation 8 may be used to determine instantaneous displacement flow and instantaneous leakage flow based on the parameters ω, α, $Disp_{g,mean}$, n, Θ, β. During operation of a pump, the parameters ω and Θ may be sensed during pump operation by one or more position sensors (e.g., one or more hall effect sensors) integrated into either a rotatable element of the pump and/or a rotor of a motor operatively coupled to the pump, and the parameter ΔP may be determined using one or more pressure sensors integrated into (a) a discharge chamber in communication with a discharge port of the pump, and/or (b) a suction chamber in communication with a suction port of the pump. In certain embodiments, the parameters ω, Θ and ΔP may serve as input parameters into the feed-forward model that approximates, based on the aforementioned parameters, an instantaneous aspect (e.g., magnitude or direction) of a ripple (e.g., a flow ripple or pressure ripple). In certain embodiments, the feed-forward model utilizes one or more ripple maps, as described below.

Generation of a Ripple Map for Use in a Feed-Forward Model

As discussed above, an accurate feed-forward model for approximating instantaneous flow ripple of a hydraulic system may be based on instantaneous leakage flow as a function of angular position of a rotating element of a gerotor (e.g., a shaft of the gerotor, an inner gear of the gerotor, an outer gear of a gerotor, a rotor of a motor operatively coupled to the gerotor) or other hydraulic pump. In certain embodiments, the parameters $Cl_g(\Theta)$ and/or β(Θ), which are used to determine instantaneous leakage flow per equations 6-8, may be determined using a ripple map generated as described in detail in this section.

Figure 9:
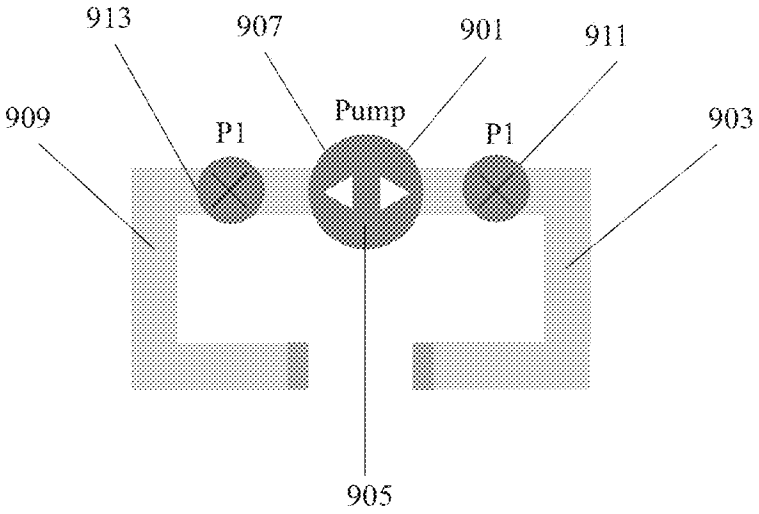
FIG. 9 illustrates an embodiment of a hydraulic test stand system for generating a ripple map.

FIG. 9 illustrates an embodiment of an exemplary external test or laboratory system that may be used for generating a pressure ripple map. In certain embodiments, a first port 901 of the pump 905 is in fluid communication with a first chamber 903 and a second port 907 of the pump is in fluid communication with a second chamber 909. In certain embodiments, the first chamber and second chamber are arranged such that the only fluid path between the first chamber and second chamber is through the pump 905. In certain embodiments, a first pressure sensor 911 detects a first pressure of the first chamber and a second pressure sensor 913 detects a second pressure of the second chamber. In certain embodiments, a position sensor (not pictured, e.g., a hall-effect sensor and optical encoder) is integrated into the pump and/or a motor operatively coupled to the pump and detects the angular position of: (i) one or more rotatable elements of the pump (e.g., a shaft, an inner gear) or (ii) a position of a rotor of the motor. In certain embodiments, the first chamber may be in fluid communication with an accumulator (not shown). In certain embodiments, the accumulator includes an accumulator piston exposed to fluid in the first chamber on a first side and a pressurized gas on a second side opposite the first side of the accumulator piston. As shown in FIG. 9, the pump may be considered to have an infinite impedance at both the inlet and outlet ends, i.e. that the only flow path present in the apparatus of FIG. 9 is across the pump. In certain embodiments, a variable flow restrictor (e.g., a needle valve) (not shown) may be placed between the first fluid chamber and the second fluid chamber. In certain embodiments, the pump is operatively coupled to a motor (e.g., a DC motor) (not shown) that is in communication with a motor controller that controls, for example, an operating torque and/or speed of the motor. The first and second pressure sensors may be, for example, commercially available pressure sensors such as an Omega PX409. The motor may be, for example, a brushless DC motor.

In order to generate a pressure ripple map, in certain embodiments, with the pump turned off, the first chamber and second chamber may pressurized to an appropriate pressure. As used herein, the term elevated pressure is understood to mean a pressure of greater than 5 psig and less than 10,000 psig. In certain embodiments, the first chamber and second chamber may be pressurized to a pressure within a range having a lower limit and an upper limit. In certain embodiments, the lower limit is one of 5 psig, 10 psig, 25 psig, 50 psig, 100 psig, 150 psig, 200 psig, 250 psig, 300 psig, 350 psig, 400 psig, 450 psig, 500 psig, 550 psig, 600 psig, 650 psig, and 700 psig, and the upper limit is one of 10000 psig, 1000 psig, 950 psig, 900 psig, 850 psig, 800 psig, 750 psig, 700 psig, 650 psig, 600 psig, 550 psig, and 500 psig. In the preferred embodiment, the first chamber and second chamber are pressurized to a pressure of at least 250 psig and less than 5,000 psig, as the inventors have recognized that pressures within this range are commonly observed in hydraulic systems of interest. In some embodiments, the first chamber and second chamber may be pressurized to pressures lower than those recited above or pressures higher than those recited above.

In certain embodiments, pressurization may be achieved by using a second pump (not shown), wherein a discharge port of the second pump is in fluid communication, via one or more valves, with the first chamber and/or second chamber. In certain embodiments, following pressurization, the one or more valves are closed such that there is no open flow path between the first chamber and the second pump and likewise no open flow path between the second chamber and the second pump. Pressurizing the first chamber and second chamber prior to obtaining a pressure ripple map and/or leakage ripple map may, for example, avoid cavitation on the suction side of the pump during operation, even at high pump speeds. Further, pressurizing the first chamber and second chamber may provide more accurate ripple data for pumps expected to be used in elevated pressure applications.

In certain embodiments, a motor controller applies a signal to a motor operatively coupled to the pump such that a time-constant torque is applied to the pump by the motor. As a result of the applied torque, the pump may begin to rotate in a first direction. Since a volume of the first chamber and a volume of the second chamber are fixed, net flow rate between the two chambers may be assumed to be approximately zero. Since in this embodiment, the only remaining path of fluid flow is through the pump, it may be assumed that an instantaneous rotational speed of the pump is proportional to an instantaneous leakage flow rate across the pump. In certain embodiments, the applied torque is maintained for a given time, and a time-averaged (e.g., mean) rotational speed of the pump is determined based on, for example, position data provided by the position sensor which may be integrated into the pump and/or motor. The mean leakage flow may be computed by taking the product of the time-averaged rotational speed and the mean displacement volume of the pump (denoted $Displ_{g,mean}$ in the equations above). The mean leakage flow coefficient (denoted $Cl_{g,mean}$ in the above equations) may then be determined by dividing the mean leakage flow by a detected time-averaged (e.g., mean) pressure differential resulting from the applied torque.

Figure 10B:
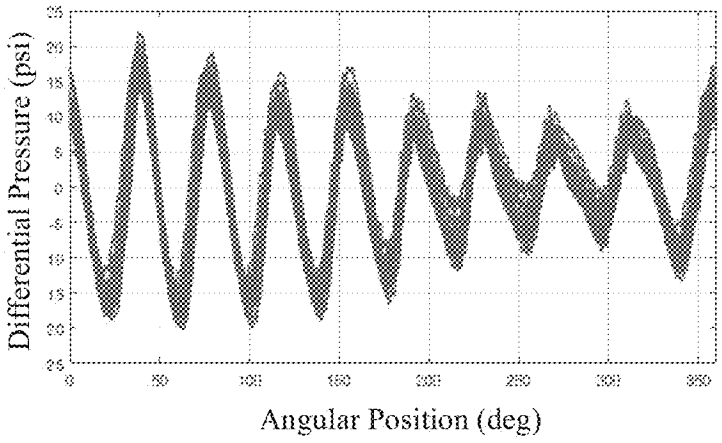
FIG. 10B illustrates an embodiment of a pressure ripple map.
Figure 10A:
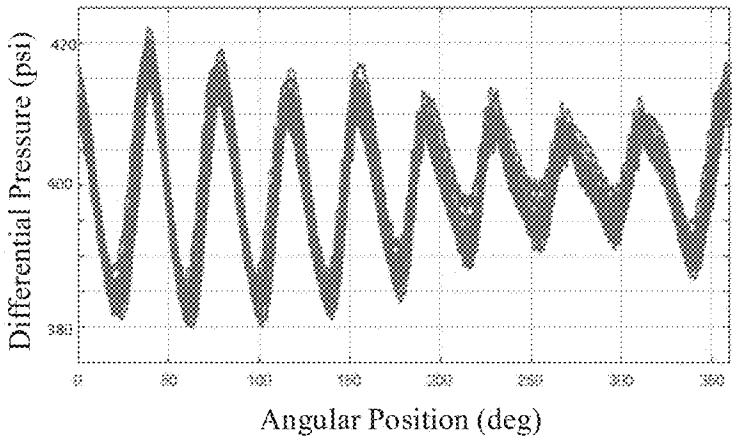
FIG. 10A illustrates an embodiment of a overall pressure differential map.

Since the volumes of the first chamber and second chamber are fixed, application of a constant applied torque to the pump coupling the first chamber and second chamber effects a pressure difference between the first and second chamber. Due to flow ripple generated by the pump, maintaining the applied torque over a given time may result in periodic modulations in an amount of fluid contained the first chamber and an amount of fluid contained in the second chamber, thereby resulting in corresponding modulations in the observed pressure differential. In certain embodiments, a pressure differential map is generated by maintaining the applied torque for a given period of time and simultaneously recording (a) pressure differential between the first chamber and second chamber (e.g., by recording a difference of the first pressure and the second pressure) and (b) angular position of one or more rotatable elements of the pump and/or a rotor of a motor operatively coupled to the pump. An example of one embodiment of a pressure differential map resulting from applying a constant torque of 40 N-M to a pump is shown in FIG. 10A. In the embodiment shown in FIG. 10A, the applied torque results in a nominal (or mean) pressure differential of approximately 400 psi, with instantaneous pressure differentials varying from approximately 380 psi to approximately 420 psi as a function of angular position of a rotor of a motor operatively coupled to the pump.

A pressure ripple map may be derived from a pressure differential map (such as that shown in FIG. 10A) by subtracting a nominal pressure differential or a time-averaged pressure differential (e.g., a mean pressure differential) from each recorded pressure differential value. An example of a pressure ripple map is shown in FIG. 10B. FIG. 10B illustrates a pressure ripple map obtained by subtracting the nominal differential pressure (400 psi) from each pressure differential value of the pressure differential map in FIG. 10A. In certain embodiments, a normalized pressure ripple map may be derived from a pressure ripple map (such as that shown in FIG. 10B) by finding a maximum value (referred to as a gain coefficient) for pressure ripple, and dividing each value by the maximum value. The non-normalized pressure ripple map shown may then be recreated from the normalized pressure ripple map by multiplying each value of the normalized pressure ripple map by the gain coefficient. As used herein, the term pressure ripple map is understood to encompass, for example, both normalized and non-normalized pressure ripple maps. In certain embodiments, a normalized pressure ripple map may be stored separately (e.g., as a separate electronic file in computer memory) from a corresponding gain coefficient value. In certain embodiments, a single normalized pressure ripple map may be associated with a plurality of gain coefficient values, each gain coefficient value corresponding to a different operating condition (e.g., different direction and/or speed of pump rotation, different nominal torque, different nominal pressure difference, different temperature of a hydraulic fluid at one or more points, etc.). Therefore, in certain embodiments a plurality of ripple maps may be stored as a single normalized ripple map and a plurality of gain coefficient values.

In certain embodiments, the pressure ripple map may be generated or stored as one or more tables (e.g., a look-up table), arrays (e.g., a one-dimensional array or a multidimensional array), plots (e.g., a two dimensional plot, a three dimensional plot), functions, integers, or any combination or permutation thereof, that relate pressure ripple to angular position of (a) one or more rotatable elements of a pump, or (b) a rotor of a motor operatively coupled to the pump.

The observed pressure differential map and/or pressure ripple map may be related to instantaneous displacement volume ($Disp_g(\Theta)$) of the pump using, for example, equation 32 below. Equation 32 may be used to relate the constant applied torque $\tau_{applied}$ and the detected pressure differential $\Delta P$ to the pump's displacement volume $Disp_g(\Theta)$. One of ordinary skill would recognize that any number of additional parameters, such as drag and inertial effects associated with movement of the pump, may also be considered.

$$\tau_{applied}=\Delta P(\theta)\cdot Disp_g(\theta) \tag{32}$$

As the applied torque is known and the pressure differential $\Delta P(\Theta)$ may be directly detected (and optionally plotted as a pressure ripple map or pressure differential map) by the aforementioned pressure sensors, the only remaining variable is the displacement volume $Disp_g$. A displacement volume map may therefore be generated that characterizes displacement volume ($Disp_g$) as a function of angular position $\Theta$. In various embodiments, a displacement volume map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating displacement volume (denoted $Disp_g$ in the above equations) to angular position of (i) one or more rotatable elements of a pump, or (ii) a rotor of a motor operatively coupled to the pump.

Having determined displacement volume ($Disp_g$) as a function of angular position $\Theta$, a displacement volume gain (a) map may be generated, for example via equation 4, that characterizes displacement volume gain (a) as a function of angular position $\Theta$. In various embodiments, a displacement volume gain (a) map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating displacement volume gain (denoted $\alpha$ in the above equations) to angular position of (i) one or more rotatable elements of a pump, or (ii) a rotor of a motor operatively coupled to the pump. In certain embodiments, a displacement volume ripple map may be generated and stored as one or more tables (e.g., a look-up table), arrays (e.g., a one-dimensional array or a multidimensional array), plots (e.g., a two dimensional plot, a three dimensional plot), functions, integers, or any combination or permutation thereof, relating displacement volume ripple to angular position of (i) one or more rotatable elements of a pump, or (ii) a rotor of a motor operatively coupled to the pump.

Having so far focused on displacement flow parameters, the focus now turns to leakage flow parameters. In certain embodiments, a leakage ripple map may be generated that characterizes one or more leakage parameters (e.g., a leakage flow, a leakage coefficient, a leakage gain) as a function of a position parameter ($\Theta$). Returning to the schematic of FIG. 9, as stated above it can be observed that the only flow path between the suction chamber and the discharge chamber is the flow path through the pump, indicating that, at constant applied torque, $Q_{gerotor}=Q_{leak}$. Combining equations 5, 8, and 9 yields equation 10.

$$Q_{gerotor}=Q_{leak} \tag{9}$$

$$\omega\cdot\alpha\cdot\sin\left(\frac{2\pi\cdot n}{360}\theta\right)+\omega\cdot Disp_{g,mean}=\Delta P(\theta)\cdot\beta(\theta)\cdot\sin\left(\frac{2\pi\cdot n}{360}\theta\right)+\Delta P(\theta)\cdot Cl_{g,mean} \tag{10}$$

The parameters $\Delta P$, $\omega$, $\Theta$, $Disp_{g,mean}$, n, $\alpha$, and $Cl_{g,mean}$ may be determined as described elsewhere in this disclosure. The only remaining variable, therefore, is leakage gain (denoted), which describes the instantaneous magnitude or amplitude of leakage flow ripple (e.g., a magnitude of the difference in instantaneous leakage flow at a given angular position as compared to mean leakage flow). As $\beta$ is the only unknown from equation 10, the equation may be rearranged to solve for $\beta$ as a function of $\Theta$, thereby generating a leakage gain map. In certain embodiments, a leakage gain map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating leakage gain ($\beta$) to angular position of (i) one or more rotatable elements of a pump, or (ii) a rotor of a motor operatively coupled to the pump.

In certain embodiments, the determined parameter $\beta$ may be used to generate a leakage coefficient ($Cl_g$) map via equation 11.

$$Cl_g(\theta)=\beta(\theta)\cdot\sin\left(\frac{2\pi\cdot n}{360}\theta\right)+Cl_{g,mean} \tag{11}$$

In certain embodiments, a leakage coefficient map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating leakage coefficient (denoted $Cl_g$ in the above equations) to angular position of (i) one or more rotatable elements of a pump, or (ii) a rotor of a motor operatively coupled to the pump.

In certain embodiments, a leakage flow map may be determined by plugging equation 11 into equation 6. In certain embodiments, a leakage flow map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating leakage flow (denoted Qleak in the above equations) to angular position of (i) one or more rotatable elements of a pump, or (ii) a rotor of a motor operatively coupled to the pump.

In certain embodiments, a leakage flow ripple map may be determined by taking the difference of instantaneous leakage flow and a mean or nominal leakage flow. In certain embodiments, a leakage flow ripple map may be stored as one or more tables (e.g., a look-up table), arrays (e.g., a one-dimensional array or a multidimensional array), plots (e.g., a two dimensional plot, a three dimensional plot), functions, integers, or any combination or permutation thereof, relating leakage flow ripple to angular position of (i) one or more rotatable elements of a pump, or (ii) a rotor of a motor operatively coupled to the pump.

As used herein, the term 'leakage ripple map' is understood to encompass leakage gain maps, leakage coefficient maps, leakage flow maps, or leakage flow ripple maps. Leakage ripple maps may be normalized or non-normalized. As would be understood by one of ordinary skill, a displacement ripple map and a leakage ripple map may be combined (e.g., using the above equations) to generate a net flow ripple map that accounts for both displacement flow ripple and leakage flow ripple. As used herein, the term 'flow ripple map' may be understood to encompass net flow ripple maps, displacement ripple maps, leakage ripple maps, and/or any combination thereof. As used herein, the term 'ripple map' is understood to encompass flow ripple maps and pressure ripple maps.

While the techniques described herein are focused specifically on a hydraulic system including a gerotor-type pump, the methods and systems disclosed may be applied to other hydraulic pumps and/or motors such as, for example, gear pumps (e.g., external gear pumps), radial piston pumps, vane pumps, and lobe pumps. One of ordinary skill in the art would be capable of modifying the methods and/or systems described herein to accommodate such different types of pumps or motors.

Active Ripple Cancellation by Feed Forward Velocity Control

Using various techniques as described above, all parameters necessary to solve equations 5 and 8 may be determined and/or detected. Equations 5 and 8, therefore, represent solvable equations that may be integrated into a feed forward model to predict or approximate instantaneous flow ripple (accounting for both displacement flow ripple and leakage flow ripple). Once instantaneous flow ripple is predicted or approximated, various techniques may be used to mitigate or at least partially cancel instantaneous flow ripple and/or effects of instantaneous flow ripple. In this section, methods and systems are described for making use of the primary flow source, the pump itself, as a cancellation flow source. It is understood that attenuation of flow ripple at the source (i.e., the pump) may result in attenuation of the resulting pressure ripple that is generated by interaction of this flow with the system.

In certain embodiments, rather than driving the pump at a particular nominal command velocity profile, the velocity of the pump may be intentionally and controllably varied during operation of the pump in order to partially cancel (e.g., prevent) flow ripple from the pump. In certain embodiments, a feed forward model may be utilized to generate a stabilized command velocity profile, such that operating the pump according to the stabilized command velocity profile at least partially cancels or prevents flow ripple (e.g., at least partially cancels displacement flow ripple and/or leakage flow ripple) as compared to operating the pump according to the nominal command velocity profile. In certain embodiments, the stabilized command velocity profile may be generated by modifying one or more velocity values specified in the nominal command velocity profile according a ripple cancellation velocity profile. In certain embodiments, a ripple cancellation velocity profile may be generated as part of the feed forward model as described in detail below.

As illustrated in equations 5 and 6, instantaneous displacement flow may be represented as a periodic function of angular position, Θ. The desired displacement flow rate, in which all displacement flow ripple has been cancelled (and displacement flow is constant), may be determined by setting $Q_{disp,ripple}$ to zero in equation 32 and rearranging to solve for $Q_{disp}$, as shown in equation 12.

$$Q_{disp}=\omega_{mean}\cdot \mathrm{Disp}_{g,mean} \tag{12}$$

Combining equation 12 and equation 5 and rearranging to solve for $\omega_{disp}$ yields an expression for a displacement velocity profile, as shown in equation 13.

$$\omega(\theta)_{disp}=\frac{\omega_{mean}\cdot Disp_{g,mean}}{\alpha\cdot\sin\left(\frac{2\pi\cdot n}{360}\theta\right)+Disp_{g,mean}} \tag{13}$$

The parameter $\omega_{disp}$ in the above equation represents a stabilized displacement velocity profile, such that operating the pump according to the stabilized displacement velocity profile results in at least partial cancellation of (e.g., reduction in the magnitude of) displacement flow ripple. In certain embodiments, the displacement velocity profile may be represented as a sum of a nominal displacement velocity profile (denoted $\omega_{nominal}$) and a displacement-ripple cancellation velocity profile (denoted $\omega_{displ\text{-}ripple,cancel}$), as shown in equations 14 and 15.

$$\omega(\theta)_{disp}=\omega_{nominal}+\omega(\theta)_{displ,cancel} \tag{14}$$

$$\omega(\theta)_{disp\text{-}ripple,cancel}=\omega(\theta)_{disp}-\omega_{nominal} \tag{15}$$

As done above for displacement flow ripple, in certain embodiments, a stabilized leakage velocity profile may be generated, such that operating the pump according to the stabilized leakage cancellation velocity profile results in at least partial cancellation of (e.g., reduction in the magnitude of) leakage flow ripple.

As illustrated in equation 8, 16, and 17, instantaneous leakage flow may be represented as a periodic function of angular position, Θ. In certain embodiments, in order to mitigate leakage flow ripple, a leakage ripple cancellation flow (denoted $Q_{leak\text{-}ripple,cancel}$) may be intentionally introduced that is equal in magnitude and opposite in direction to the leakage flow ripple, as represented in equation 18.

$$Q_{leak\text{-}ripple,cancel}=-Q_{leak,ripple} \tag{18}$$

In certain embodiments, the leakage ripple cancellation flow is introduced by varying the angular velocity at which the pump is operated, as shown in equation 19. Combining equations 17, 18, 19, and 4 yields an equation for a leakage-ripple cancellation velocity profile ($\omega_{leak\text{-}ripple,cancel}$), as shown in equation 20. The nominal command velocity profile may be modified according to the leakage-ripple cancellation velocity profile to generate a stabilized leakage velocity profile.

$$Q_{leak\text{-}ripple,cancel}=\omega(\theta)_{leak\text{-}ripple,cancel}\cdot \mathrm{Disp}_g(\theta)$$

$$\omega(\theta)_{leak\text{-}ripple,cancel}=-\frac{\Delta P\cdot\beta\cdot\sin\left(\frac{2\pi\cdot n}{360}\theta\right)}{\alpha\sin\left(\frac{2\pi\cdot n}{360}\theta\right)+Disp_{g,mean}}=\frac{Q_{leak,ripple}(\theta)}{\alpha\sin\left(\frac{2\pi\cdot n}{360}\theta\right)+Disp_{g,mean}} \tag{20}$$

Equations 16 and 20 allow for determination of a displacement-ripple cancellation velocity profile and a leakage-ripple cancellation velocity profile. As used herein, the term "ripple cancellation velocity profile" is understood to mean a displacement-ripple cancellation velocity profile, a leakage-ripple cancellation velocity profile, or any combination or permutation thereof. In certain embodiments, the pump is operatively coupled to a motor, which is in communication with a motor controller. In certain embodiments, the motor controller is configured to control an angular velocity of the motor (and therefore an angular velocity of the pump) by applying a controlled electrical signal (e.g., a voltage of a determined magnitude and direction) to the motor. In certain embodiments, the motor controller receives a nominal command speed value as an input parameter. In certain embodiments, the motor controller receives, as an input parameter, a nominal command velocity profile which specifies a desired velocity profile over a given time period. In certain embodiments, the nominal command speed or nominal command velocity profile may be received from an external controller in communication with the motor controller. In certain embodiments, the nominal command speed or nominal command velocity profile may be received from a user.

In certain embodiments, the motor controller may be configured to determine a ripple cancellation velocity profile. In certain embodiments, the ripple cancellation velocity profile may be one or more of: a displacement-ripple cancellation velocity profile, a leakage-ripple cancellation velocity profile, and the sum of a displacement-ripple cancellation velocity profile and a leakage-ripple cancellation velocity profile. In certain embodiments, the ripple cancellation velocity profile may be determined using a feed forward model. For example, the above equations (e.g., equation 15, 20, and associated equations) may be used in the feed forward model to determine the displacement-ripple cancellation velocity profile and/or the leakage-ripple cancellation velocity profile. In certain embodiments, the motor controller may be configured to access one or more ripple maps, and the ripple cancellation velocity profile is determined based, at least in part, on information obtained from the one or more ripple maps. For example, as the leakage-ripple cancellation velocity profile (see equation 20) depends on leakage ripple ($Q_{leak,ripple}$), a leakage flow ripple map may be accessed to determine the leakage flow ripple value for a given angular position. In certain embodiments, the motor controller may additionally or alternatively receive, as an input, a position parameter. In certain embodiments, the position parameter is generated by a rotary position sensor (e.g., a hall-effect sensor) integrated into the pump and/or a motor operatively coupled to the pump that detects the angular position of: (i) one or more rotatable elements of the pump (e.g., a shaft, an inner gear) or (ii) a position of a rotor of the motor In certain embodiments, the motor controller may additionally or alternatively receive, as an input, one or more pressure parameters. In certain embodiments, the pressure parameter may be generated by one or more pressure sensors integrated into a discharge volume and/or suction volume in communication with a discharge port and/or suction port, respectively, of the hydraulic pump. In certain embodiments, the motor controller may be configured to determine the cancellation velocity profile, based at least in part on the position parameter, the one or more pressure parameters, information obtained from one or more ripple maps, and/or any combination or permutation thereof.

In certain embodiments, the motor controller is configured to generate the stabilized command velocity profile by combining (e.g., adding, overlaying) the ripple cancellation velocity profile and the nominal command velocity profile. In certain embodiments, the motor controller is configured to apply a series of signals (e.g., electrical signals (e.g., voltages)) to the motor operatively coupled to the pump, thereby causing the pump to operate according to the stabilized command velocity profile. In certain embodiments, operating the pump according to the stabilized command velocity profile results in a stabilized discharge flow having an average flow ripple magnitude less than would be observed by operating the pump according to the nominal command velocity profile.

In certain embodiments, rather than having the motor controller operate the feed forward model, a cancellation controller(s) may be utilized. A cancellation controller may include one or more processors and associated software code that causes the processor(s) to predict or approximate flow ripple according to the feed forward model. In certain embodiments, the cancellation controller(s) or motor controller are in communication with one or more external sensors (e.g., a position sensor that detects angular position of one or more rotatable elements of a pump and/or angular position of a rotor of a motor operatively coupled to the pump). In certain embodiments, the cancellation controller(s) or motor controller utilize information received from the external sensors (e.g., an instantaneous angular position, an instantaneous pump velocity) in the feed forward model to predict or approximate instantaneous flow ripple in order to generate the cancellation velocity profile using, for example, relationships and equations described herein. In certain embodiments, the cancellation controller (s) or motor controller also access a ripple map for use in the feed forward model. In certain embodiments, the cancellation controller(s) or motor controller is in communication with the motor controller. In certain embodiments, the cancellation controller(s) or the function of the cancellation controller(s) may be integrated partially or completely into a motor controller (e.g., the cancellation controller and motor controller may share one or more hardware components such as microprocessors, memory, etc.).

Active Ripple Cancellation by Feed Forward Torque Control

In certain embodiments, rather than controlling a speed or velocity of the pump, the motor controller may be configured to control a torque applied by the motor to the pump. In these embodiments, a stabilized command torque profile may be generated (e.g., by a feed forward model), such that operating the pump according to the stabilized command torque profile at least partially cancels or prevents flow ripple (e.g., at least partially cancels displacement flow ripple and/or leakage flow ripple) as compared to operating the pump according to a nominal command torque profile. In certain embodiments, the stabilized command torque profile may be generated by modifying one or more torque values specified in the nominal command torque profile according a ripple cancellation torque profile. In certain embodiments, a ripple cancellation torque profile may be generated as part of the feed forward model as described in detail below.

In certain embodiments, a displacement-ripple cancellation torque profile may be generated based on a displacement-ripple cancellation velocity profile described in the previous section. In certain embodiments, the displacement-ripple cancellation velocity profile ($\omega_{disp\text{-}ripple,cancel}$) may be differentiated with respect to time (equations 21-22), and the displacement ripple cancellation torque profile ($\tau_{Disp\text{-}ripple,cancel}$) may be determined based on the differential and the rotational inertia (Jg) of the system (equation 23).

$$\frac{\partial \omega_{disp\text{-}ripple,cancel}}{\partial t} = \frac{\partial \omega_{disp\text{-}ripple,cancel}}{\partial \theta} \cdot \frac{\partial \theta}{\partial t} = \frac{\partial \omega_{disp\text{-}ripple,cancel}}{\partial \theta} \cdot \omega \tag{21}$$

$$\frac{\partial \omega_{disp\text{-}ripple,cancel}}{\partial \theta} = \frac{-\omega_{mean} \cdot Disp_{g,mean} \cdot \alpha \cdot \frac{2\pi \cdot n}{360} \cdot \cos\left(\frac{2\pi \cdot n}{360}\theta\right)}{\left(\alpha \cdot \sin\left(\frac{2\pi \cdot n}{360}\theta\right) + Disp_{g,mean}\right)^2} \tag{22}$$

$$\tau_{Disp\text{-}ripple,cancel}(\theta) = J_g \cdot \frac{\partial \omega_{disp\text{-}ripple,cancel}}{dt} \tag{23}$$

Likewise, a leakage-ripple cancellation torque profile may be generated based on a leakage-ripple cancellation velocity profile described in the previous section. In certain embodiments, the leakage-ripple cancellation velocity profile ($\omega_{leak\text{-}ripple,cancel}$) may be differentiated with respect to time (equations 25-26), and the displacement ripple cancellation torque profile ($\tau_{leak\text{-}ripple,cancel}$) may be determined based on the differential and the rotational inertia (Jg) of the system (equation 27).

$$\frac{\partial \omega_{leak\text{-}ripple,cancel}}{\partial t} = \frac{\partial \omega_{leak\text{-}ripple,cancel}}{\partial \theta} \cdot \frac{\partial \theta}{\partial t} = \frac{\partial \omega_{leak\text{-}ripple,cancel}}{\partial \theta} \cdot \omega \tag{25}$$

$$\frac{\partial \omega_{leak\text{-}ripple,cancel}}{\partial \theta} = \frac{\Delta P \cdot \beta \frac{2\pi \cdot n}{360} \cdot cos\left(\frac{2\pi \cdot n}{360}\theta\right)}{Disp_{g,mean}} \tag{26}$$

$$\tau_{leak\text{-}ripple,cancel} = J_g \cdot \frac{\partial \omega_{leak\text{-}ripple,cancel}}{dt} \tag{27}$$

Further, in certain embodiments an additional torque parameter may be considered, termed reaction torque. Without wishing to be bound to any particular theory, existence of a pressure differential across a pump may result in a reaction torque being applied to the pump, per, for example, equations 28-29. The first term in equation 29 represents the periodic portion of the reaction torque (herein termed "reaction torque ripple"), while the second term corresponds to the nominal, or mean, reaction torque. Reaction torque ripple is understood to relate to angular position dependent deviations in a reaction torque applied to the pump due to a pressure differential across the pump.

$$\tau_{reaction}(\theta) = \Delta P \cdot \mathrm{Disp}_g(\theta) \tag{28}$$

$$\tau_{reaction}(\theta) = \Delta P \cdot \alpha \cdot \sin\left(\frac{2\pi \cdot n}{360}\theta\right) + \Delta \mathrm{P} \cdot Disp_{gmean} \tag{29}$$

$$\tau_{reaction}(\theta) = \tau_{reaction\text{-}ripple}(\theta) + \tau_{reaction,nominal} \tag{30}$$

In certain embodiments, a reaction-ripple cancellation torque profile may be intentionally applied to the pump that is equal in magnitude and opposite in direction to the characterized reaction torque ripple. The magnitude of the reaction-ripple cancellation torque profile may be represented by equation 31.

$$\tau_{reaction\text{-}ripple,cancel}(\theta) = \Delta P \cdot \alpha \cdot \sin\left(\frac{2\pi \cdot n}{360}\theta\right) \tag{31}$$

Three ripple cancellation torques profiles have thus been described: a displacement-ripple cancellation torque profile that represents a torque profile necessary to at least partially cancel displacement flow ripple; a leakage-ripple cancellation torque profile that represents a torque profile necessary to at least partially cancel leakage flow ripple; and a reaction-ripple cancellation torque profile that represents a torque profile necessary to at least cancel reaction torque ripple. As used herein, the term "ripple cancellation torque profile" is understood to mean any of: a displacement-ripple cancellation torque profile, a leakage-ripple cancellation torque profile, a reaction-ripple cancellation torque profile, and/or any combination (e.g., a single torque profile that sums or otherwise combines values from at least two of the aforementioned torque profiles) or permutation thereof.

In certain embodiments, the pump is operatively coupled to a motor, which is in communication with a motor controller. In certain embodiments, the motor controller is configured to control a torque applied by the motor to the pump. In certain embodiments, the applied torque is controlled by applying a controlled electrical signal (e.g., a current of a determined magnitude) to the motor.

In certain embodiments, the motor controller is configured to generate a stabilized command torque profile by combining (e.g., adding, overlaying) a nominal command torque profile with one or more ripple cancellation torque profiles. In certain embodiments, the motor controller is configured to apply a series of signals (e.g., electrical signals (e.g., currents)) to the motor operatively coupled to the pump, thereby causing the pump to operate according to the stabilized command torque profile. In certain embodiments, operating the pump according to the stabilized command torque profile results in a stabilized discharge flow having an average flow ripple magnitude less than would be observed by operating the pump according to the nominal command torque profile.

Figure 11B:
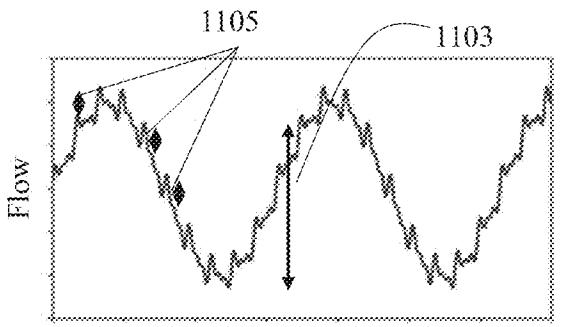
FIGS. 11A, 11B, 11C, and 11D illustrate a nominal torque profile, a corresponding observed flow profile, a corresponding stabilized torque profile, and a corresponding stabilized observed flow profile, respectively.
Figure 11D:
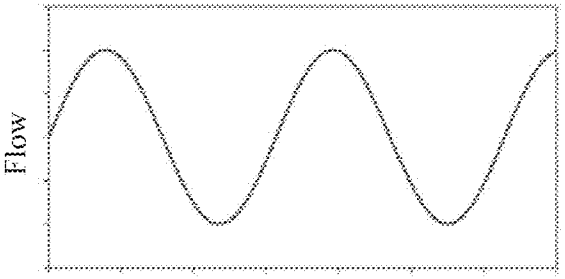
Figure 11A:
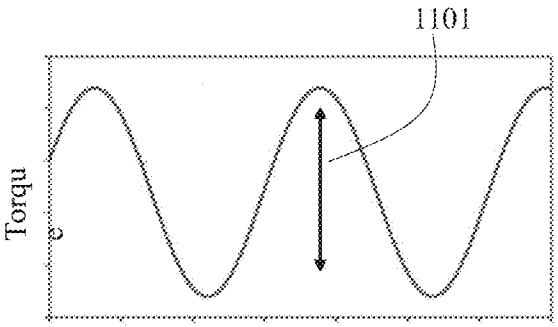

An example of a nominal command torque profile that may be received by the motor controller is shown in FIG. 11A. The nominal command torque profile specifies the nominal torque to apply to the pump over a given period of time. The application of the torque profile shown in FIG. 11A produces the flow profile shown in FIG. 11B. As can be seen in FIG. 11B, actual flow across the hydraulic pump includes low frequency, large amplitude oscillations 1103 corresponding to oscillations in the applied torque 1101, as well as higher frequency oscillations 1105 due to the flow ripple phenomenon discussed above. As discussed, such flow ripple may result in pressure ripple that may, for example, destabilize the system, create acoustic noise, and/or contribute to other non-desirable consequences. The ratio of the frequency of the flow ripple to the nominal flow (or pressure ripple to nominal pressure) is typically greater than 4. In some embodiments the ratio may be greater than 10. In yet other embodiments the ratio may be greater 100.

Figure 11C:
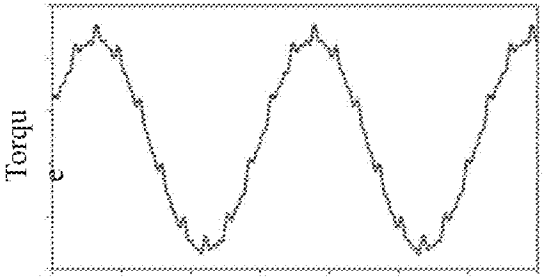

FIG. 11C illustrates a stabilized command torque profile generated by combining the nominal command torque profile from FIG. 11A with a ripple cancellation torque profile. Application of the stabilized command torque profile shown in FIG. 11C may fully counteract, or at least partially mitigate (e.g., decrease the magnitude of), the flow ripple observed in in FIG. 11B. FIG. 11D illustrates flow across the pump in which flow ripple has been fully cancelled.

In certain embodiments, the motor controller receives a nominal command torque value as an input parameter. In certain embodiments, the nominal command torque value or nominal command torque profile may be received from an external controller in communication with the motor controller. In certain embodiments, the nominal command torque value or nominal command torque profile may be received from a user. In certain embodiments, the motor controller may determine the nominal command torque value or nominal command torque profile based on a command force or command pressure differential value or profile, as described above.

In certain embodiments, the motor controller may be configured to determine a ripple cancellation torque profile. In certain embodiments, the ripple cancellation torque profile may be one or more of: a displacement-ripple cancellation torque profile, a leakage-ripple cancellation torque profile, a reaction-ripple cancellation torque profile, and a sum of any combination or permutation thereof. In certain embodiments, the ripple cancellation torque profile may be determined using a feed forward model. For example, the above equations (e.g., equation 23, 27, 31, and associated equations) may be used to determine the displacement-ripple cancellation torque profile, leakage-ripple cancellation torque profile, and/or reaction-ripple cancellation torque profile. In certain embodiments, the motor controller may be configured to access one or more ripple maps, and the ripple cancellation torque profile may be determined based, at least in part, on information obtained from the one or more ripple maps. For example, as the leakage-ripple cancellation torque profile (see equation 26 and 27) depends on leakage gain (β), a leakage gain map may be accessed to determine the leakage gain (β) for a given angular position.

In certain embodiments, the motor controller may additionally or alternatively receive, as an input, a position parameter. In certain embodiments, the position parameter is generated by a rotary position sensor (e.g., a hall-effect sensor) integrated into the pump and/or a motor operatively coupled to the pump that detects the angular position of: (i) one or more rotatable elements of the pump (e.g., a shaft, an inner gear) or (ii) a position of a rotor of the motor In certain embodiments, the motor controller may additionally or alternatively receive, as an input, one or more pressure parameters. In certain embodiments, the pressure parameter may be generated by one or more pressure sensors integrated into a discharge volume and/or suction volume in communication with a discharge port and/or suction port, respectively, of the hydraulic pump. In certain embodiments, the motor controller may be configured to determine the ripple cancellation torque profile, based at least in part on the position parameter, the one or more pressure parameters, information obtained from one or more ripple maps, and/or any combination or permutation thereof.

In certain embodiments, the motor controller may have access to a plurality of ripple maps, each ripple map corresponding to a different operating condition of, for example, the hydraulic motor-pump, electric motor-generator, vehicle, and/or actuator (e.g., different nominal pressure differential, nominal applied force, nominal operating torque, temperature, operating mode, etc.). In these embodiments, the motor controller may be configured to identify an appropriate ripple map of the plurality for use in the feed-forward model based on instantaneous operating conditions.

Examples of Ripple Maps & Model

Having described various methods and systems to generate and/or utilize ripple maps, examples of several embodiments of ripple maps will now be illustrated and discussed. Table 1 depicts a portion of an embodiment of a first ripple map implemented in the form of a table.

TABLE 1

| Angular position (Θ) (degrees) | Leakage Gain (β) |
|---|---|
| 0 | 2.1 |
| 1 | 2.3 |

TABLE 1-continued

| Angular position (Θ) (degrees) | Leakage Gain (β) |
|---|---|
| 2 | 2.3 |
| 3 | 1.9 |
| 4 | 2.0 |
| 5 | 2.3 |
| 6 | 1.9 |
| . . . | . . . |
| 358 | 2.0 |
| 359 | 1.9 |
| 360 | 2.1 |

As can be seen, the ripple map of Table 1 relates leakage gain (denoted pin the above equations) to angular position (Θ) of the pump and/or of a rotor of a motor operatively coupled to the pump. The ripple map exemplified in Table 1 is therefore an embodiment of a leakage gain map. Table 1 comprises a plurality of leakage gain values, with each leakage gain value corresponding to a different angular position. In the exemplified embodiment, angular position is specified in segments of one degree. In alternative embodiments, angular position may be specified using radians or any other unit of angular position. In alternative embodiments, angular position may be specified in any fraction or multiple of a degree or radian. In the embodiment of Table 1, leakage gain values are specified for a range of angular positions of 0°-360°. In alternative embodiments, a ripple map may specify values of a parameter for any range of angular positions.

In certain embodiments the leftmost column denoting angular position may be omitted. In these embodiments, a controller accessing the leakage gain map may be configured to recognize that each subsequent value for leakage gain corresponds to a certain angular position. For example, the controller may be programmed to recognize that the $10^{th}$ row corresponds to, for example, an angular position of 10°, while the $50^{th}$ row corresponds to, for example, and angular position of 50°.

During operation of a pump implementing active ripple cancellation, in certain embodiments the motor controller or other controller may receive a position parameter corresponding to an instantaneous angular position at a given time, and may evaluate a leakage gain map (e.g., the leakage gain map exemplified in Table 1) in order to obtain an appropriate value for leakage gain (β) based on the angular position. The motor controller may then use the appropriate value for leakage gain in a model (utilizing, for example, equations 26 and 27) to determine an appropriate ripple cancellation torque profile or ripple cancellation torque velocity, as described in detail above.

Alternatively, rather than relying on a position sensor to determine instantaneous angular position at a given time, the motor controller (or other controller) may predict an angular position that will occur at some point in the future. For example, the controller may use a known angular position corresponding to a position of the pump at a first point in time, along with a velocity of the pump, to predict the angular position at a second point of time in the future. For example, if a controller knows that a position of a pump was 3° at a first point in time, and that the pump is operating at a constant velocity of 20° per second, the controller may predict a position of the pump at any time after the first point in time. In certain embodiments, therefore, the controller may determine a velocity or velocity profile of the pump and may predict a future angular position of the pump at a future point in time based on the operating velocity of the pump. In certain embodiments, the controller may then access a ripple map (e.g., the leakage gain map exemplified in Table 1) in order to obtain an appropriate flow parameter (e.g., a leakage gain value) to use to model the future point in time. In certain embodiments, the controller may determine a velocity or velocity profile of the pump based on a position sensor or velocity sensor integrated into the pump or a motor operatively coupled to the pump. In other embodiments, the controller may calculate an expected velocity or velocity profile of the pump based on a command velocity profile or command torque profile.

Another embodiment of leakage gain map is depicted in Table 2a.

TABLE 2a

| Angular position (Θ) | Leakage Gain (β) |
|---|---|
| 0 | 2 |
| 1 | 2 |
| 2 | 2 |
| 3 | 2 |
| 4 | 2 |
| 5 | 2 |
| 6 | 2 |
| . . . | 2 |
| 358 | 2 |
| 359 | 2 |
| 360 | 2 |

Unlike the leakage gain map exemplified in Table 1, the leakage gain map exemplified in Table 2a includes only a single leakage gain value that is constant for all angular positions. Since the leakage gain map exemplified in Table 2a specifies only a single leakage gain value, the left-most column of Table 2a is unnecessary. Table 2b depicts an alternative representation of the leakage gain map exemplified in Table 2a.

TABLE 2b

| Leakage Gain (β) |
|---|
| 2 |

The inventors have recognized that a ripple map comprising a single value for a leakage parameter (e.g., leakage gain, a leakage coefficient) and/or a displacement parameter (e.g., a displacement volume gain) may require less memory to store, and/or may require less processing power to evaluate, than a ripple map comprising a plurality of values for the leakage parameter and/or the displacement parameter (e.g., the leakage gain map shown in Table 1). Therefore, in certain embodiments (as exemplified in Table 2a or Table 2b), a leakage ripple map or displacement ripple map may specify a single leakage parameter and/or displacement parameter that is to be used for all angular positions.

Conversely, the inventors have recognized that, in certain applications, ripple may be more effectively attenuated or prevented by considering a plurality of values for a leakage parameter and/or a displacement parameter, each value corresponding to a different angular position of the pump. Without wishing to be bound to any particular theory, in a gear pump (e.g., a gerotor or external gear pump), leakage occurs in part due to insufficient sealing between a first tooth of a first gear and a second tooth of a second gear. Theoretically, if every tooth of a gear were exactly the same, leakage flow in a gear pump may be perfectly described using a constant leakage gain (e.g., as shown in Table 2a or Table 2b) or constant leakage coefficient. However, the inventors have recognized that, due to defects introduced by manufacturing, there may be variations in dimensions of a first tooth of a gear as compared to dimensions of a second tooth of the gear. These variations in dimensions between different teeth in a single gear may lead to leakage parameters (such as, for example, leakage gain and/or leakage coefficient) that vary as the gear rotates (e.g., that vary a function of angular position, as shown in Table 1). Similar rational can be applied in considering displacement flow, or for considering flow in other types of pumps. Therefore, in certain embodiments a leakage ripple map or displacement ripple map may comprise a plurality of values for a given leakage parameter (e.g., leakage gain, leakage coefficient) or displacement parameter (e.g., displacement volume gain, displacement volume), respectively, wherein each value corresponds to a given angular position of the pump or a motor operatively coupled to the pump.

In certain embodiments, a plurality of ripple maps may be stored, wherein each of the ripple maps is associated with a tag specifying a corresponding operating parameter. Table 3 depicts an example of an embodiment of a plurality of leakage gain maps.

TABLE 3

| | Leakage Gain (β) | | | |
|---|---|---|---|---|
| Angular position (Θ) | Map 1 T = 50° F. | Map 2 T = 60° F. | Map 3 T = 70° F. | Map 4 T = 80° F. |
| 0 | 2 | 2.2 | 1.6 | 1.8 |
| 1 | 2 | 2.4 | 2.2 | 2.5 |
| 2 | 2 | 2.3 | 2.3 | 1.5 |
| 3 | 2.3 | 2 | 1.6 | 2.1 |
| 4 | 2.3 | 1.5 | 2.1 | 2.4 |
| 5 | 2 | 2.3 | 1.9 | 1.8 |
| 6 | 2.4 | 1.9 | 2.1 | 1.5 |
| . . . | 1.7 | 1.9 | 1.6 | 2.2 |
| 358 | 1.5 | 2 | 2.3 | 1.7 |
| 359 | 2 | 2.1 | 2.4 | 1.6 |
| 360 | 2.2 | 2.5 | 1.6 | 1.7 |

Each of the second, third, fourth, and fifth columns of Table 3 embody a leakage gain map (labeled Map 1, Map 2, Map 3, and Map 4, respectively) that specifies leakage gain as a function of angular position. As can be seen in Table 3, each leakage gain map corresponds to a different reference operating temperature. For example, Map 1 (the second column) embodies a leakage gain map associated with a reference operating temperature of 50° F., while Map 4 (the fifth column) embodies a leakage gain map corresponding to a reference operating temperature of 80° F. The inventors have recognized that changes in temperature (either ambient temperature or temperature of fluid at one or more points in a hydraulic circuit) may affect pump operation. Without wishing to be bound to a particular theory, changes in temperature may cause contraction or expansion of various components of a pump, thereby affecting displacement parameters and/or leakage parameters (e.g., contraction of pump components may create voids, caused by insufficient sealing, through which leakage flow may occur) of a pump. Changes in temperature may further affect viscosity of the fluid being pumped, which may affect pump operation. Similarly, changes in operating pressure of a hydraulic circuit, velocity (magnitude or direction) of the pump or motor operatively coupled to the pump, torque applied to the pump, and other factors may affect displacement parameters and/or leakage parameters of a pump. For example, without wishing to be bound to a particular theory, different operating pressures and/or different applied torques may induce stress on various parts of the pump. This stress may result in physical deformations of pump components, thereby affecting displacement parameters and/or leakage parameters.

Therefore, in certain embodiments, a controller may have access to a plurality of ripple maps, each ripple map being associated with a different reference operating condition (e.g., an ambient temperature, a temperature of hydraulic fluid at one or more points in a hydraulic circuit comprising the pump; an operating direction of the pump and/or motor operatively coupled to the pump; an operating velocity of the pump and/or motor, an applied torque on the pump; an operating pressure difference across the pump; an operating pressure at a point in a hydraulic circuit comprising the pump, etc.). In order to select an appropriate ripple map from the plurality of ripple maps, an operating condition may be characterized (e.g., detected (e.g., via a temperature sensor integrated into the pump or hydraulic circuit, via an external temperature sensor, via a position or velocity sensor integrated into the pump and/or motor, etc.)), and the appropriate ripple map may be selected by comparing the detected operating condition to each reference operating condition associated with each ripple map. For example, returning to the plurality of ripple maps depicted in Table 3, a controller may receive, from a temperature sensor, a current ambient temperature reading of 60° F. The controller would select the ripple map of Table 3 that corresponds to a temperature of 60° F. (i.e., Map 2), and would use the selected ripple map (i.e., Map 2) to obtain a leakage gain parameter for a given angular position.

Alternatively, a detected operating condition may not correspond exactly to any reference operating condition associated with the stored ripple maps. For example, returning now to Table 3, a controller may receive a current ambient temperature reading of 67° F. which does not correspond exactly to any of the reference operating conditions of any of the ripple maps of Table 3. In certain embodiments, an appropriate ripple map may be selected by identifying the ripple map associated with a reference operating condition most similar to the detected operating condition (e.g., for the case of a temperature reading of 67° F. Map 3 of Table 3, associated with a reference operating condition of 70° F., would be selected). Alternatively, in certain embodiments, a value may be determined by extrapolating or interpolating based on a first value of a first ripple map associated with a reference operating condition below the detected operating condition and a second value of a second ripple map associated with a reference operating condition above the detected operating condition. Alternatively, in certain embodiments, each ripple map of a plurality of ripple maps may be associated with ranges of reference operating conditions (e.g., a first ripple map may be associated with an operating temperature of 70° F.-80° F., a second ripple map may be associated with an operating temperature of 80° F.-90° F. etc.). An appropriate ripple map may be determined by detecting an operating condition, assigning the detected operating condition to an appropriate range or bin, and selecting an appropriate ripple map corresponding to the range or bin of reference operating conditions that encompasses the detected operating condition.

The ripple maps depicted above are understood to represent non-limiting examples intended to illustrate a non-comprehensive set of embodiments. Various embodiments of ripple maps may incorporate any number of modifications to the specific arrangements of ripple maps depicted above.

Figure 20:
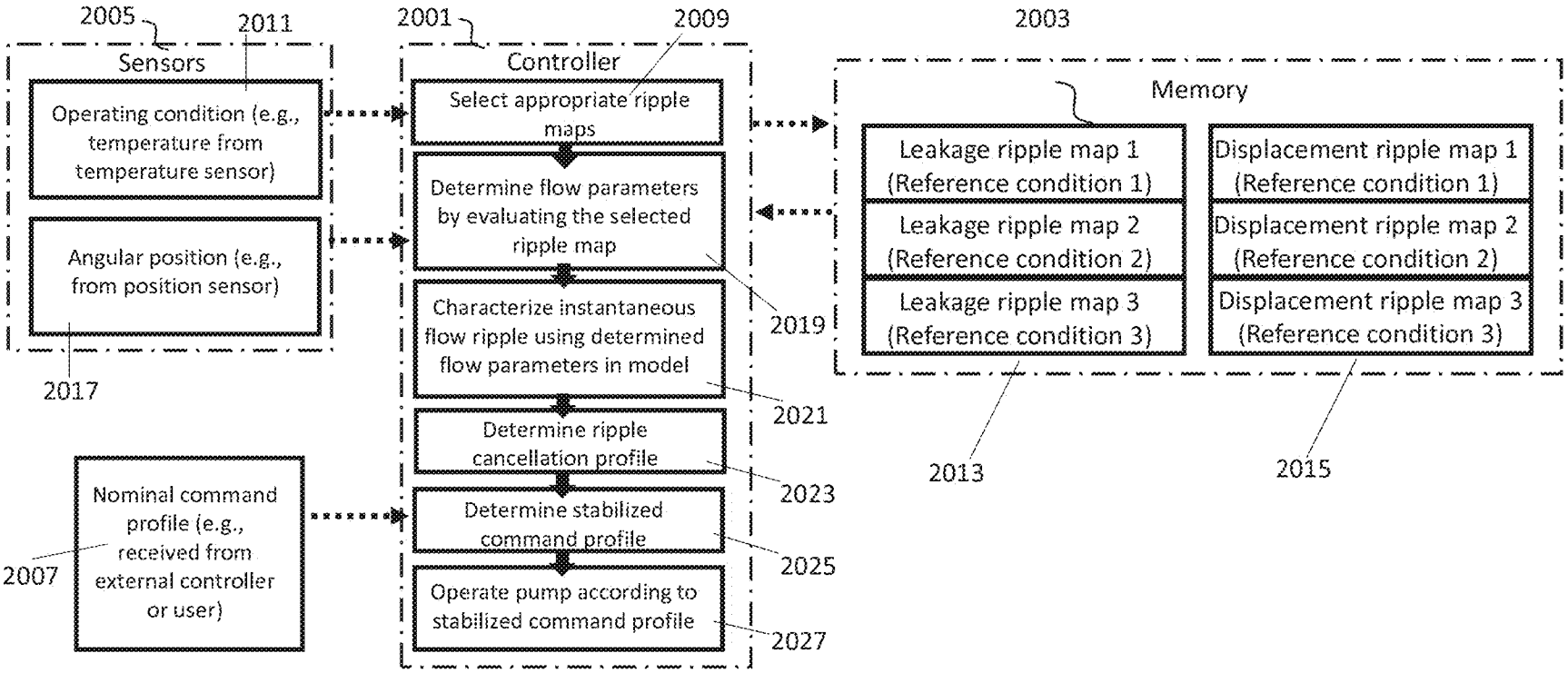
FIG. 20 illustrates a block diagram of a controller for mitigating ripple utilizing a feed forward model to operate a positive displacement pump.

A flow chart of an exemplary process for operating a hydraulic pump to attenuate or prevent flow ripple generated by the pump is depicted in FIG. 20. In the exemplary embodiment, a controller 2001 (which may, in certain embodiments, be a motor controller) is in communication with a computer readable memory 2003 and one or more sensors 2005 (e.g., a temperature sensor and a position sensor integrated into the pump). In the exemplary embodiment, the controller 2001 also receives a nominal command profile 2007 (e.g., a nominal command torque profile or a nominal command velocity profile) from, for example, a user or an external controller. The memory 2003 may store a plurality of ripple maps such as, for example, a plurality of leakage ripple maps 2013 and a plurality of displacement ripple maps 2015. Each of the plurality of ripple maps may be associated with a reference operating condition.

In a first step 2009, the controller 2001 may receive a signal corresponding to a certain operating condition 2011 (e.g., a temperature of fluid inside the pump) from one of the sensors 2005. Based on the detected operating condition 2011, the controller may select one or more appropriate ripple maps from the plurality of ripple maps 2013, 2015 stored in the memory 2003.

As described previously, the appropriate ripple maps may be selected, for example, by identifying one or more ripple maps associated with a reference operating condition matching the detected operating condition.

The controller 2001 may receive a position signal indicating an angular position 2017 of the pump. The position signal may be provided by, for example, a position sensor integrated into the pump. In a second step 2019, the controller may evaluate the appropriate ripple maps to identify one or more flow parameters (e.g., a leakage parameter from an appropriate leakage ripple map and/or a displacement parameter from an appropriate displacement ripple map) corresponding to the detected angular position. Following identification of flow parameters 2019, in a third step 2021 the controller may utilize a model (e.g., equations 1-11 and associated equations above) employing the flow parameters determined in the second step 2019 in order to characterize an aspect (e.g., a magnitude, a direction) of instantaneous flow ripple. If the model requires additional parameters (for example, $\Delta P$) to characterize instantaneous flow ripple, these additional parameters may also be determined by the controller. For example, $\Delta P$ may be characterized by one or more pressure sensors integrated into the hydraulic circuit comprising the pump in communication with the controller, or may be characterized based on a torque applied to the pump, as described above.

Once instantaneous flow ripple has been characterized, in a fourth step a ripple cancellation profile (e.g., a ripple cancellation velocity profile and/or ripple cancellation torque profile) may be determined based on the characterized aspects of the instantaneous flow ripple. In a fifth step 2025, a stabilized command profile (e.g., a stabilized command velocity profile, a stabilized command torque profile) may be generated. In certain embodiments, the stabilized command profile may be generated by modifying one or more values contained in a nominal command profile 2007 (received, for example, from a user or external controller) according to the determined ripple cancellation profile. In a final step 2027, the controller operates the pump according to the stabilized command profile. For example, if the pump is operatively coupled to an electric motor (e.g., a BLDC), the controller may determine an electrical signal based on the stabilized command profile and may apply the electrical signal to the motor operatively coupled to the pump, thereby causing the pump to operate according to the stabilized command profile.

The process steps and arrangement of components illustrated in FIG. 20 (e.g. controller, sensors, memory, etc.) are understood to represent a non-limiting example intended to illustrate only a single, non-comprehensive set of embodiments. Various embodiments may incorporate numerous modifications to the specific arrangement of steps and components depicted in FIG. 20. For example, it is understood that the order of the steps depicted in FIG. 20 may be rearranged, specific steps may be removed, additional steps may be included, two or more steps may be combined or carried out simultaneously, one or more steps may be carried out by one or more additional controllers, the memory may be integrated into the controller, ripple maps may be distributed over a plurality of memories, etc. Such modifications are considered to be well within the abilities of one of ordinary skill in the art in view of the teachings of the present disclosure.

Pressure Balanced Active Buffer (PBAB)

In another aspect, methods and systems for partially or fully cancelling flow ripple using a pressure balanced active buffer are described. Active buffers operate by varying a volume of a buffer reservoir in fluid communication with at least the outlet port of a pump. When instantaneous pump output is below the nominal flow value, the buffer reduces the volume of the buffer reservoir, causing fluid to flow from the reservoir to the hydraulic circuit. When instantaneous pump output is above the nominal flow value, the buffer increases the volume of the buffer reservoir, causing a portion of the pump output to be captured in the buffer reservoir. While active buffers have been proposed previously as a method to mitigate flow ripple, practical applications of such active buffers have thus far been limited, for reasons described in detail below, to applications employing low operating pressures. As described herein, the inventors have recognized that an active buffer comprising a pressure balancing mechanism (referred to as a "pressure balanced active buffer") may be used across a much wider range of operating conditions and applications.

Figure 12:
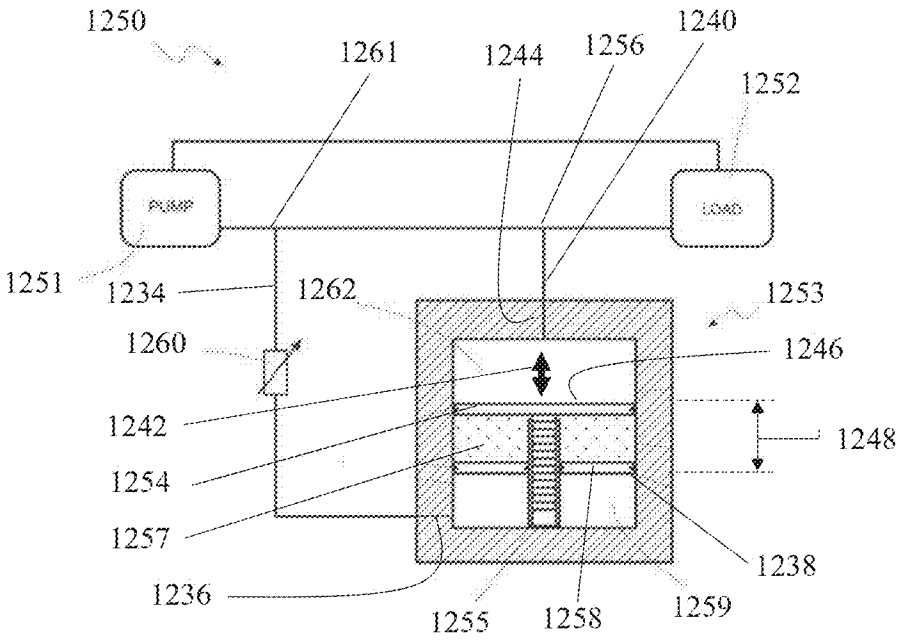
FIG. 12 illustrates an embodiment of a hydraulic system with a pressure-balanced active buffer ("PBAB").

A schematic of an active buffer is illustrated in FIG. 12. FIG. 12 illustrates a hydraulic circuit 1250 with a hydraulic pump 1251, a hydraulic load 1252 and an active buffer 1253. In certain embodiments, the active buffer includes a piston assembly 1248 with a first surface 1246 exposed to fluid in a buffer reservoir 1262. The first surface 1262 may be part of a buffer piston 1254 physically attached or otherwise held in contact with an actuator 1255. As illustrated in FIG. 12, in certain embodiments the active buffer further includes a buffer port 1244. As used herein, the term buffer port is understood to mean any aperture or opening that allows fluid to flow into and/or out of the buffer reservoir 1262. In certain embodiments, the buffer port is coupled to a first port 1256 on the hydraulic circuit 1250 by a first flow channel 1240.

During operation of the illustrated embodiment, an actuator controller (not shown) applies an actuator cancellation signal to the actuator 1255, causing the actuator to either expand or compress in an axial direction 1242. As used herein, the term actuator controller is understood to mean one or more integrated circuits (such as, for example, processors) and the associated software and/or electronic circuitry to produce and apply a modulable signal (e.g., electrical signal such as, for example, an applied voltage) to the actuator such that the actuator expands or contracts in response to the applied signal. In certain embodiments, the actuator controller may be integrated into a motor controller in communication with a motor driving the hydraulic pump 1251, such that a single controller serves the function of both a motor controller and an actuator controller.

Expansion or compression of the actuator 1255 results in motion of the buffer piston 1254 along the axial direction 1242. Particularly, expansion of the actuator 1255 results in movement of the buffer piston 1254 in a first axial direction (e.g., upwards in the illustrated embodiment), thereby reducing a volume of the buffer reservoir 1262 and inducing flow from the buffer reservoir 1262, through the first flow channel 1240, and into the hydraulic circuit 1250. Conversely, compression of the actuator 1255 results in movement of the buffer piston 1254 in a second axial direction (e.g., downwards in the illustrated embodiment), thereby increasing a volume of the buffer reservoir 1262 and capturing fluid from the hydraulic circuit 1250.

The fluid in the hydraulic circuit 1250 exerts a force on the buffer piston in the second axial direction (e.g., downwards in the illustrated embodiment), said force equal to the operating pressure of the fluid times the cross sectional area of the piston exposed to the buffer reservoir 1262. In the absence of pressure balancing, the first surface 1246 of the buffer piston 1254 must support the full operating pressure of the hydraulic circuit 1250, and movement of the buffer piston 1254 in a first axial direction (e.g., upwards) requires overcoming said force. The practical application of non-pressure balanced active buffers is limited to operating pressures below a critical value since, at operating pressures above some critical value, the actuator 1255 is unable to apply sufficient force to overcome the fluid force exerted on the piston due to the hydraulic pressure of the fluid in the buffer reservoir 1262. The inventors have therefore recognized that, in certain hydraulic systems and applications, it is important to at least partially balance the pressure across the buffer piston 1254. As recognized by the inventors, a pressure-balanced active buffer may operate over a wide range of operating pressures. Further, pressure balancing of the actuator may allow for the use of smaller and less expensive actuators.

In the embodiment illustrated in FIG. 12, pressure balancing is achieved by exposing a second surface 1238 of the piston assembly 1248 to fluid in a balance reservoir 1259, the second surface 1238 opposite the first surface 1246 of the piston assembly 1248. In certain embodiments, the piston assembly 1248 includes a balance piston 1258, and the second surface 1238 is part of the balance piston 1258. In certain embodiments, the balance piston 1258 may be oriented such that the axial direction of the balance piston is parallel to the axial direction 1242 of the buffer piston. In certain embodiments, the balance reservoir 1259 includes a balance port 1236 to allow a portion of fluid from the hydraulic circuit to enter the balance reservoir. As used herein, the term balance port is understood to mean any aperture or opening that allows fluid to flow into and/or out of the balance reservoir 1259. In certain embodiments, as illustrated, the balance port 1236 is coupled to a second port 1261 on the hydraulic circuit 1250 by a second flow channel 1234. Alternatively, in certain embodiments, the balance port 1236 is coupled to the first port 1256 of the hydraulic circuit 1250 by a second flow channel 1260 that branches off of the first flow channel 1240. Alternatively, as illustrated by FIG. 2 PBAB, the second flow channel 1260 may couple the balance port 1236 to the buffer reservoir 1262.

In certain embodiments, as illustrated in FIG. 12, the piston assembly includes an intermediate chamber 1257 interposed between the balance piston 1258 and the buffer piston 1254. In certain embodiments, as illustrated, a compressible fluid (e.g., a gas) partially or fully occupies a volume of the intermediate chamber. In certain embodiments, the compressible fluid is air.

In various embodiments, the first flow channel 1240 and second flow channel 1234 may be any combination of tubes, hoses, pipes, and/or hollow volumes integrated into a housing of the active buffer. In various embodiments, the first flow channel and second flow channel may be flexible, semi-flexible, rigid, detachable, or permanent, as the disclosure is not so limited.

In the embodiment illustrated in FIG. 12, both the buffer reservoir 1262 and the balance reservoir 1259 are in fluid communication with the hydraulic circuit 1250. As a result, both the buffer reservoir 1262 and the balance reservoir 1259 may experience effectively equal operating pressures. Due to the operating pressure of the fluid, fluid in the buffer reservoir 1262 may apply a downward force on the piston assembly 1248 while fluid in the balance reservoir 1259 may apply an effectively equal (due to the pressures being effectively equal) upward force on the piston assembly 1248. The forces acting on the piston assembly 1248 due to fluid pressure effectively cancel out, and so the active buffer is said to be pressure-balanced.

In the illustrated embodiment, by designing the system such that the first port 1256 is located between the outlet port of a pump 1251 and the hydraulic load 1252, flow ripple that is present at the outlet port of the pump 1251 may be partially or fully cancelled before reaching the load 1252, such that the flow and/or pressure observed at the load 1252 is effectively constant (e.g., flow ripple is partially or fully mitigated before reaching the load). When instantaneous flow at the outlet port of the pump 1251 is below a nominal value, the actuator controller applies an actuator cancellation signal to the actuator 1255 such that the actuator 1255 expands in an axial direction 1242, thereby inducing flow from the buffer reservoir 1262 into the hydraulic circuit 1250 at the first port 1256. When instantaneous flow at the outlet port of the pump 1251 is above the nominal value, the actuator controller applies an actuator cancellation signal to the actuator 1255 such that the actuator 1255 is compressed in an axial direction 1242, thereby capturing a portion of fluid flowing between the outlet port of the pump 1251 and the load 1252.

For the sake of clarity, in the embodiments described above, reference is made to "upward" and "downward" directions. However, it should be understood that the pressure-balanced active buffer may be oriented in any direction, as the disclosure is not so limited. For example, the pressure-balanced active buffer may be oriented such that the buffer reservoir and buffer piston are located below the balance reservoir and balance piston. Alternatively, the pressure-balanced active buffer may be oriented horizontally, such that the buffer reservoir and buffer piston are located to the left or right of the balance reservoir and balance piston. Alternatively, the pressure balanced active buffer may be oriented at any angle with respect to horizontal.

In certain embodiments, the actuator 1255 is a piezoelectric actuator operatively coupled to the piston 1258. In certain embodiments, the actuator is a piezoelectric stack. In certain embodiments, one or more additional actuators may be coupled to the piston such that they are positioned in parallel with the actuator to provide additional force on the buffer piston. In embodiments in which the actuator 1255 is a piezoelectric actuator, the actuator cancellation signal is an electrical voltage. In these embodiments, the actuator controller modulates the electrical voltage applied to the piezoelectric actuator, thereby causing expansion or contraction of the piezoelectric actuator. In certain embodiments, the actuator controller includes a piezo stack amplifier, as is known in the art. In other embodiments, the actuator may be a electromagnetic actuator (e.g. solenoid).

To determine an appropriate actuator cancellation signal, the actuator controller may utilize a closed-loop control system (e.g., a feedback based system) and/or an open-loop (e.g., feed-forward) control system. As discussed previously, an open-loop control system, in which a feed forward model may be utilized to predict or approximate flow ripple and/or pressure ripple using a variety of inputs without directly measuring instantaneous flow ripple and/or pressure ripple, may be beneficial especially at high velocities of pump operation. In certain embodiments, the actuation controller includes one or more processors and associated software code that causes the processor(s) to predict or approximate instantaneous flow ripple according to the feed forward model.

Figure 13:
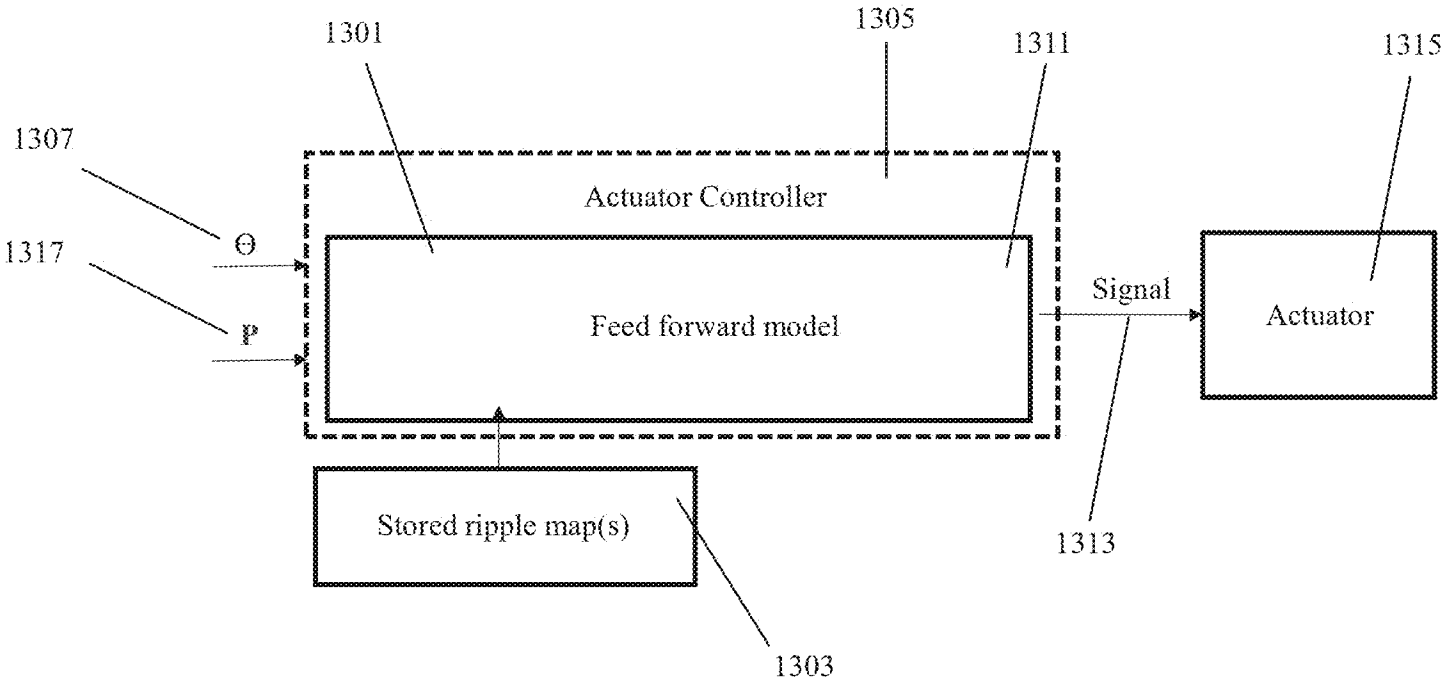
FIG. 13 illustrates an embodiment of an open-loop control system.

For example, the above equations (e.g., equation 32, 17, and/or associated equations) may be used in a feed forward model to determine instantaneous flow ripple due to leakage flow ripple and/or displacement flow ripple. FIG. 13 illustrates a block flow diagram of open loop operation of the PBAB embodiment according to one embodiment. In certain embodiments, the actuator controller 1305 may be configured to access one or more ripple maps 1303, and the actuator cancellation signal 1313 may be determined based, at least in part, on information obtained from the one or more ripple maps. For example, a leakage flow ripple map may be accessed to determine the leakage flow ripple value for a given angular position. In certain embodiments, the actuator controller may additionally or alternatively receive, as an input, a position parameter 1307. In certain embodiments, the position parameter is generated by a rotary position sensor (e.g., a hall-effect sensor) integrated into the pump and/or a motor operatively coupled to the pump that detects the angular position of: (i) one or more rotatable elements of the pump (e.g., a shaft, an inner gear) or (ii) a position of a rotor of the motor. In certain embodiments, the actuator controller may additionally or alternatively receive, as an input, one or more pressure parameters. In certain embodiments, a pressure parameter 1317 may be generated by one or more pressure sensors integrated into one or more reservoirs of the active buffer, and/or a discharge volume and/or suction volume in communication with a discharge port and/or suction port, respectively, of the hydraulic pump. In certain embodiments, the actuator controller may be configured to determine the actuator cancellation signal 1313 based, at least in part on the position parameter, the one or more pressure parameters, information obtained from one or more ripple maps, and/or any combination or permutation thereof. In certain embodiments, the actuator controller 1305 may utilize a feed forward model 1301 to characterize an aspect of instantaneous ripple, and the actuator cancellation signal 1313 may be determined based on the characterized aspect.

In certain embodiments, the actuator controller 1305 may receive, as an input, one or more power parameters corresponding to a characteristic of electrical power being consumed by the pump (such as, for example, back EMF), and the actuator controller may be configured to determine the actuator cancellation signal 1313 based, at least in part, on the one or more power parameters. In certain embodiments, the pressure-balanced active buffer 1253 may be integrated into the pump 1251.

Operational Examples of PBAB Operation

Figure 14:
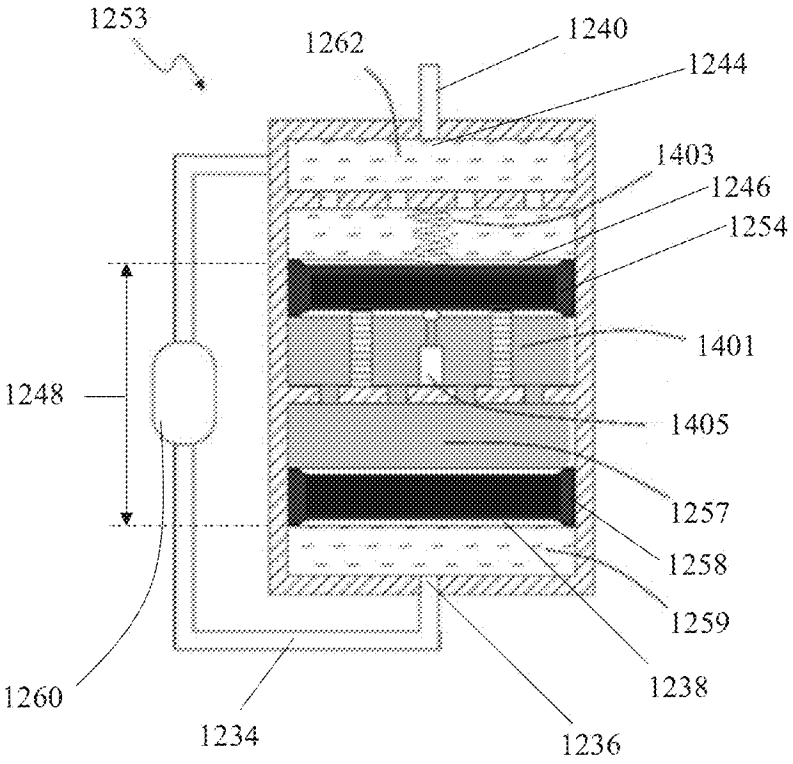
FIG. 14 illustrates another embodiment of a pressure-balanced active buffer.

In order to demonstrate the effectiveness of a pressure-balanced active buffer utilizing a feed-forward control algorithm as described above, a pressure-balanced active buffer of the embodiment illustrated in FIG. 14 was empirically tested in a hydraulic circuit. FIG. 14 illustrates an embodiment of a pressure-balanced active buffer including three piezoelectric stack actuators 1401 uniformly deployed (at 120°) increments such that the points of contact between each of the actuators 1401 and the buffer piston 1254 are located equidistant from a central axis of the buffer piston. As illustrated in FIG. 14, in certain embodiments the second flow channel 1234 includes a low pass filter 1260. In certain embodiments, the low pass filter may be a restriction orifice. In certain embodiments, the low pass filter may be a Helmholtz oscillator. As further illustrated in FIG. 14, in certain embodiments the pressure-balanced active buffer includes a spring 1403 located in the buffer reservoir 1262. In certain embodiments, when no actuator cancellation signal is applied, the actuators 1401 are biased in a compressed position by the spring 1403. In certain embodiments, the spring is a washer. In certain embodiments, the spring is a coil spring. In the tested embodiment, the spring was a stiff Belleville washer CDM-602130. In the tested embodiment, the pressure-balanced active buffer further includes a buffer piston position sensor 1405, to detect the linear position of the buffer piston 1254. In certain embodiments, the buffer piston position sensor may be a displacement sensor.

In order to appropriately size the tested PBAB embodiment for operation with the pump used in the testing, the anticipated flow ripple of the pump was predicted using a specialized CFD software package (PumpLinx®). The software was configured to compute flow ripple as a function of pump shaft position and the resulting estimates were later validated in multiple contexts by analyses of a wide range of experimental and operational data.

Several parameters that were considered in the course of the CFD pump analyses included:

- Geometric details of the inner and outer rotors of the pump.
- The approximate magnitude of total pump volume ripple as a function of speed and pressure (including displacement ripple and leakage ripple). This quantity was determined by using a detailed CFD and Simulink model of the pump.
- Expected operating pressure range.

This analysis indicated that the total flow volume of the ripple produced by the pump was approximately 0.0025 $in^3$ or $4.3\times10^{-8}$ $m^3$ per lobe of the gerotor. The actuators 1401 were commercially available piezoelectric stacks and exhibited a maximum stroke of 70 μm and a blocked force of 1800N each for actuating the PBAB device. The buffer piston of the PBAB embodiment was designed with a diameter of 2.9 in. The mechanical spring was used to apply a preload of approximately 900N per actuator with a spring rate of approximately 60,000 lbs/in. Based on the mass of the aluminum piston, the theoretical mechanical resonant frequency was estimated to be 1.6 kHz which provided sufficient bandwidth for the hardware that was tested.

Without wishing to be bound to any particular theory, the low pass filter 1260 serves to prevent transmission of high frequency pressure ripple to the balance reservoir 1259 while allowing transmission of lower frequency changes in bulk or nominal pressure in order to balance the PBAB system. In this manner, the same bulk pressure is applied to first surface 1246 of the piston assembly (the first surface being part of the buffer piston 1254) and the second surface 1238 of the piston assembly (the second surface being part of the balance piston 1248). The volume of the intermediate chamber 1257 may change slightly so that the pressure of the compressible fluid within the intermediate chamber 1257 closely tracks that of the bulk or nominal pressure. As a result, the pressure across the buffer piston remains effectively balanced even when faced with large changes in overall system pressure. In this manner, the actuators 1401 are protected from large pressure swings and are mainly exposed only to much smaller amplitude pressure ripple.

In certain embodiments, the low pass filter may be a restriction orifice. In the tested embodiment, a partially open ball calve was used as an adjustable restriction orifice to perform the function of the low pass filter 1260. In certain embodiments, a Helmholtz oscillator may be used as the low pass filter 1260. Without wishing to be bound to any particular theory, the cutoff frequency ($\omega_{cutoff}$) of a Helmholtz oscillator may be related to the compliance ($dP/dV_{fluid}$) of the compressible fluid in the intermediate chamber 1257 and various geometric parameters including the cross-sectional area of the second flow channel 1234 ($A_{v2}$), the length of the second flow channel 1234 ($L_{v2}$), and the density of the hydraulic fluid (ρ), per the following equation:

$$\omega_{cutoff} = \frac{1}{2\pi}\sqrt{\frac{dP/dV_{fluid}A_{V2}^2}{A_{V2}L_{V2}\rho}}$$

By sizing the various parameters, the cutoff frequency of the low pass filter 1260 can be selected depending on the requirements of the target system. In certain embodiments, a Helmholtz oscillator within the device is utilized to achieve automated dynamic pressure balancing that is appropriately frequency selective. The cutoff frequency should generally be chosen to be above the desired frequency at which the system is to operate in a pressure balanced manner.

The performance of the embodiment of a pressure-balanced active buffer illustrated in FIG. 13 was evaluated empirically in a hydraulic system with a pump operating at three different speeds. The table below summarizes the operating condition and the level of mitigation of pressure ripple experienced at the hydraulic load achieved at the first and second harmonics of the pump.

TABLE I

SUMMARY OF TEST RESULTS

| Condition | Speed (RPM) | Pressure Ripple Reduction | Pressure Ripple Reduction |
|---|---|---|---|
| 1 | 500 | 95%-99% (25-40 db) | 90% (20 db) |
| 2 | 800 | 95%-99% (25-40 db) | 90% (20 db) |
| 3 | 1,700 | 95% (25 db) | NA |

During a test, the Phase angles φ and γ, as well as the amplitudes α and β in the cancellation equations above, were adjusted until close to optimal pressure cancellation was achieved at the 1st harmonic. The procedure is repeated for subsequent harmonics (n=2, 3 . . . ). Amplitudes and phase angles for each harmonic were adjusted until maximal ripple cancellation was achieved at that harmonic. It is estimated, based on the pressure response, that harmonics greater than the $1^{st}$ harmonic will require progressively lower amplitude than the $1^{st}$ harmonic. During these tests, the acquired performance data included bulk pressure in the buffer reservoir as well as the intermediate chamber, high frequency pressure at both sides of the pump and at the first chamber of the PBAB, angular position of the pump, driving current of the pump controller, linear position of the buffer piston in the PBAB, and driving voltage signal to the piezo stacks, as well as current draw from the piezo stack amplifier. Measurements were acquired at a sampling rate of 20 kHz, sufficiently high to capture all harmonics of interest in this case. The results are stated and plotted based on the high frequency pressure at the outlet of the pump, a. Experimental Results at 500 RPM ($1^{st}$ Harmonic)

Figure 15:
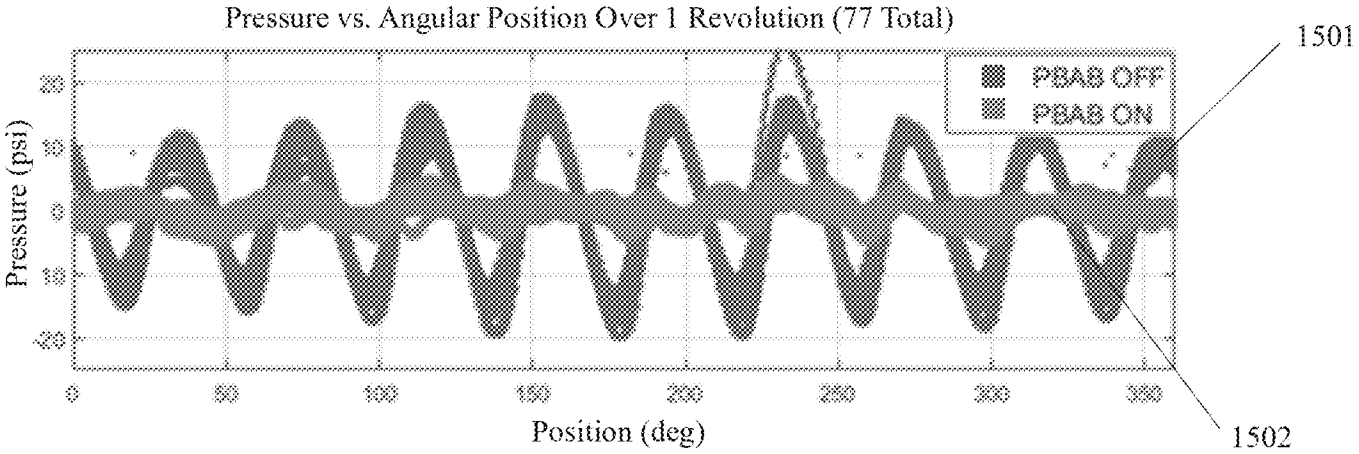
FIG. 15 illustrates experimental results of a hydraulic system with a pressure-balanced active buffer.

FIG. 15 illustrates a plot of pressure ripple with the pressure-balanced active buffer ("PBAB") turned off 1501 and pressure ripple with the pressure-balanced active buffer turned on 1502. As can be seen, use of the pressure-balanced active buffer significantly decreases the amplitude of observed pressure ripple. In the first set of performance validation tests, the pump was operated at approximately 500 RPM. The regularity of the pressure ripple with respect to pump position allows for very repeatable pressure response plots vs. angular position for the pump rotating at an average speed of 500 RPM and a mean pressure differential of around 100 psi.

As shown in FIG. 15, the angular position repeats itself after 360 mechanical degrees and the pressure is then wrapped along the x-axis. Every revolution is repeatable with only minor differences. A single pumping cycle of the gerotor pump occurs over 40 mechanical (shaft) degrees and cycle-to-cycle variations in pressure are apparent. During the test, the speed of the pump varies by over 100 RPM during each cycle due to the internal displacement and leakage fluctuations. The results are, therefore, shown in the position domain.

Figure 16:
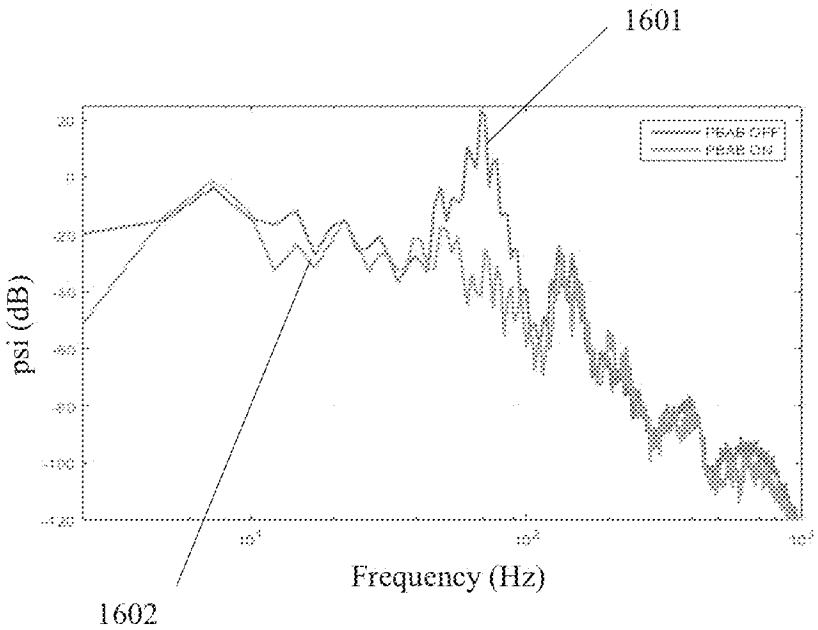
FIG. 16 illustrates additional experimental results of a hydraulic system with a pressure-balanced active buffer.

The power spectral density of this data is shown in FIG. 16. With the PBAB device turned on 1603, excellent overall attenuation of the 1st harmonic can be observed in the plot when compared to operation with the PBAB device turned off 1601. From the plot, it is apparent that the 1st harmonic in this test is distributed from 50 Hz up to nearly 100 Hz. This behavior is due to the fluctuations in pump speed. Excellent attenuation levels, between 95%-99% (25 dB and 40 dB), were achieved over this range.

Figure 17:
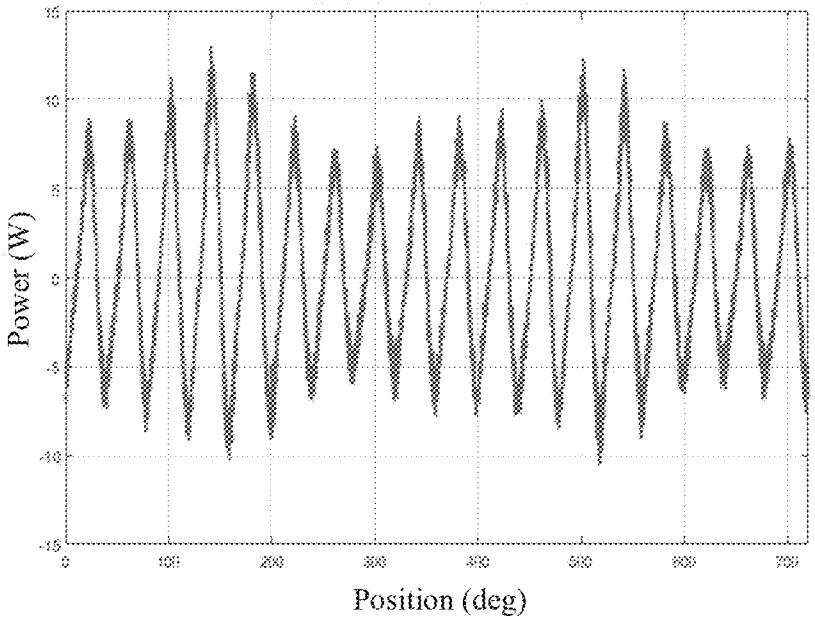
FIG. 17 illustrates further experimental results of a hydraulic system with a pressure-balanced active buffer.

FIG. 17 is a plot of instantaneous power for this test. The peak power to drive the device is approximately 12 W of active and 11 W of regenerative power. This figure illustrates another key advantage of the PBAB system. Due to the regenerative nature of the device, the mean power is very nearly zero. The minimal 0.3 W may be due to the conversion efficiency in the power electronics.

b. Experimental Results at 500 RPM (1st and 2nd Harmonics)

Figure 18:
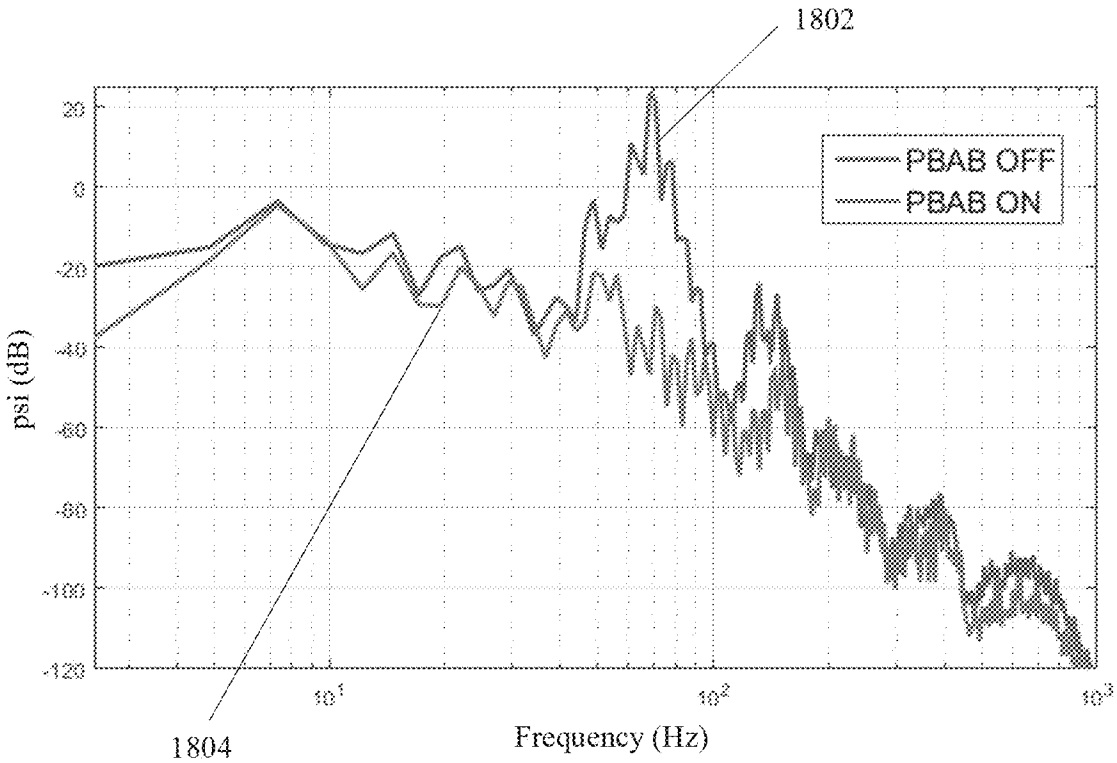
FIG. 18 illustrates additional experimental results of a hydraulic system with a pressure-balanced active buffer.

Operating at 500 RPM, the PBAB was toggled off and on and included a 1st and 2nd harmonic actuator cancellation signal. Similar to FIG. 8 above, excellent attenuation of the 1st harmonic is achieved, while very substantial attenuation of the 2nd harmonic is also achieved. The 2nd harmonic occurs at a frequency range where the 1-2 ms latency of the electronics affects the phasing of the signal to a significant degree. Results for operation at 500 RPM are shown in FIG. 18 for operation of the pump with the PBAB turned on 1804 and operation of the pump with the PBAB turned off 1802.

c. Experimental Results at 800 RPM and 1,700 RPM ($1^{st}$ Harmonic)

Figure 19B:
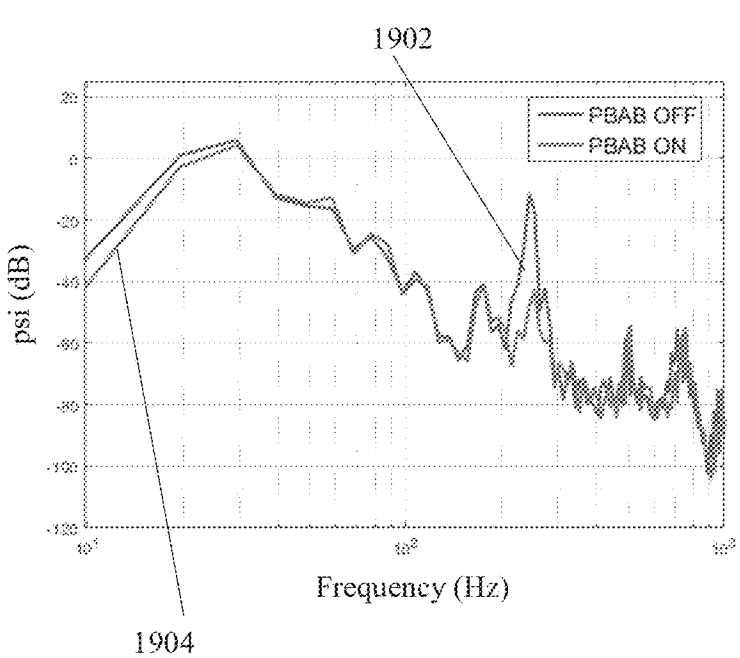
FIG. 19B illustrates additional experimental results of a hydraulic system with a pressure-balanced active buffer.
Figure 19A:
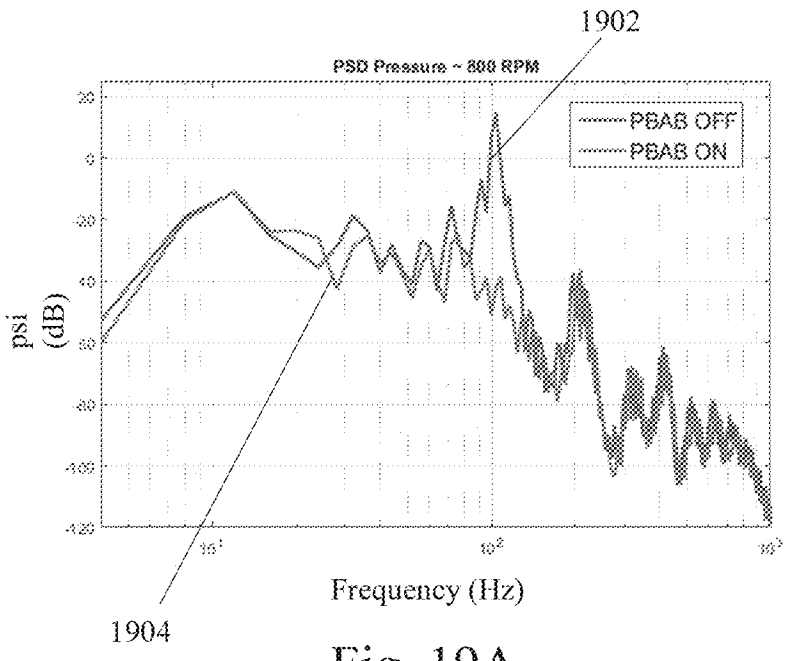
FIG. 19A illustrates further experimental results of a hydraulic system with a pressure-balanced active buffer.

Similar tests were run at different driving torque levels and different hydraulic load settings, resulting in different pressure differentials and different rotational speeds. Results for operation at 800 RPM is shown in FIG. 19A for operation of the pump with the PBAB turned on 1904 and activation of the pump with the PBAB turned off 1902. Results for operation at 1,700 RPM are shown in FIG. 19B for operation of the pump with the PBAB turned on 1904 and operation of the pump with the PBAB turned off 1902.

In the two plots above, the hydraulic load was adjusted to achieve average speeds of 800 RPM and 1700 RPM, respectively. The frequency of 1st harmonic ripple increases accordingly in each case. As in the case of the 500 RPM test, both the 800 RPM and 1700 RPM tests demonstrated excellent mitigation in the targeted frequencies. The attenuation levels achieved with the PBAB running are excellent, again measuring between 25 dB and 40 dB. It is noted that at an average of 1700 RPM, the 1st harmonic frequency spans a range between 220 Hz and 280 Hz.

The above-described embodiments of the technology described herein can be implemented in any of numerous ways. For example, certain elements of the embodiments may be implemented using hardware, software or a combination thereof. When implemented in software, the software code can be executed on any suitable processor or collection of processors, whether provided in a single computing device or distributed among multiple computing devices. Such processors may be implemented as integrated circuits, with one or more processors in an integrated circuit component, including commercially available integrated circuit components known in the art by names such as CPU chips, GPU chips, microprocessor, microcontroller, or co-processor. Alternatively, a processor may be implemented in custom circuitry, such as an ASIC, or semicustom circuitry resulting from configuring a programmable logic device. As yet a further alternative, a processor may be a portion of a larger circuit or semiconductor device, whether commercially available, semi-custom or custom. As a specific example, some commercially available microprocessors have multiple cores such that one or a subset of those cores may constitute a processor. Though, a processor may be implemented using circuitry in any suitable format.

Such computing devices may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, elements of the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, certain elements from the disclosure may be embodied as a computer readable memory (or multiple computer readable media) (e.g., ROM, EPROM, flash memory, one or more floppy discs, compact discs (CD), optical discs, digital video disks (DVD), magnetic tapes, circuit configurations in Field Programmable Gate Arrays or other semiconductor devices, or other tangible computer storage medium) encoded with one or more programs that, when executed on one or more computers or other processors, perform methods that implement the various embodiments of the disclosure discussed above. As is apparent from the foregoing examples, a computer readable memory may retain information for a sufficient time to provide computer-executable instructions in a non-transitory form. Such a computer readable memory or media can be transportable, such that the program or programs stored thereon can be loaded onto one or more different computers or other processors to implement various aspects of the present disclosure as discussed above. As used herein, the term "computer readable memory" encompasses only a non-transitory computer-readable medium that can be considered to be a manufacture (i.e., article of manufacture) or a machine. Alternatively or additionally, certain elements from the disclosure may be embodied as a computer readable medium other than a computer-readable memory, such as a propagating signal.

The terms "program" or "software" are used herein in a generic sense to refer to any type of computer code or set of computer-executable instructions that can be employed to program a computer or other processor to implement various aspects of the present disclosure as discussed above. Additionally, it should be appreciated that according to one aspect of this embodiment, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable memory in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

Glossary of Terms

Hydraulic motor-pump: As used herein, a "hydraulic motor-pump" is understood to mean a hydraulic device that is capable of converting mechanical kinetic energy into a fluidic pressure difference in a first operational mode and/or capable of converting fluidic pressure difference into mechanical kinetic energy in a second operational mode. A hydraulic motor-pump may be a hydraulic pump or a hydraulic motor that may be operated as a hydraulic pump. Unless context clearly indicates otherwise, the term hydraulic motor-pump is used interchangeably with "hydraulic pump" or "pump" herein.

Motor-generator: As used herein, a "motor-generator" is an electromechanical device that is capable of converting electrical energy into mechanical kinetic energy in a first operational mode and/or capable of converting mechanical kinetic energy into electrical energy in a second operational mode. A motor-generator may be an electric motor or an electric generator that may be operated as an electric motor. Unless context clearly indicates otherwise, the term motor-generator is used interchangeably with "electric motor" or simply "motor."

Rotatable element of a pump: As used herein, a "rotatable element of a pump" is understood to mean a component integrated into a housing of a pump that is configured to rotate relative to the housing during operation of the pump. Depending on the type of pump, a rotatable element of a pump may include a shaft of the pump, a gear of the pump (e.g., an internal gear of the pump, an external gear of the pump, a gerotor gear), and/or a rotor of the pump. A rotatable element of a pump may also be referred to as an active element or active component of the pump.

Operatively coupled: A motor-generator is said to be "operatively coupled" to a pump when (i) causing the rotation of a rotor of the motor-generator results in a rotation of one or more rotatable elements of the pump and/or (ii) causing the rotation of a rotatable element of the pump results in a rotation of the rotor of the motor-generator.

Position of a pump, speed or velocity of a pump, direction of a pump, rotation of a pump: A position of a pump (sometimes referred to as an "angular position of a pump), a speed or velocity of a pump, and a direction of a pump are understood to mean an angular position (relative to the pump housing), angular speed or velocity, and direction of rotation, respectively, of one or more rotatable elements of the pump. A position of a rotor or speed of a rotor, is understood to mean an angular position (relative to the pump housing) or rotational speed, respectively, of the rotor. The term rotation of a pump is understood to mean rotation of one or more rotatable elements of the pump relative to the pump housing.

Applying a torque to a pump: As used herein, the term applying a torque "to a pump" is understood to mean applying a torque to one or more rotatable elements of the pump.

Operating a pump: As used herein, the term "operating a pump" or "operating a positive displacement pump" is understood to mean applying a torque to the pump, thereby causing one or more rotatable elements of the pump to rotate with a certain velocity. Operating a pump may be referred to as "driving the pump," or similar verbiage well known in the at. A pump may be operated according to a torque profile specifying one or more torque values to be applied to the pump (sometimes referred to as "torque control" in the art), or may be operated according to a velocity profile specifying a velocity value or a plurality of velocity values for the pump (sometimes referred to as "velocity control" or "speed control" in the art).

Damper: As used herein, the term "damper" is understood to mean a device capable of changing a dimension (e.g., extending or compressing its length) in response to a mechanical force. A damper may include a movable element (e.g., a piston) that moves, relative to a damper housing, in a first direction (e.g., vertically upwards) during extension of the damper and in a second direction (e.g., vertically downwards) during compression of the damper. A damper is further characterized in that, in response to the mechanical force causing the change in dimension of the damper, a resistive force may be exerted on the movable element in a direction opposite the direction of its motion, thereby resisting said motion. A magnitude of the resistive force may be related to both a velocity of said motion of the movable element and a damping coefficient. Unlike an actuator, a damper is not capable of generating and applying a force to the movable element in the direction of the motion of the movable element. Further, unlike an actuator, a damper is not capable of generating and applying a force to the movable element in the absence of motion of the movable element. A damper may therefore be said to operate in a maximum of two quadrants (e.g., quadrant I and III) of a force-velocity diagram.

Passive damper: A passive damper is understood to mean a damper with effectively a constant damping coefficient, such that the magnitude of the resistive force applied to the movable element in response to its motion is effectively a function only of the velocity of the motion at a given temperature.

Semi-active damper: A semi-active damper is understood to mean a damper in which it is possible to intentionally vary or control a damping coefficient. In certain semi-active dampers, the magnitude of the resistive force applied to the movable element during motion may be arbitrarily controlled-however, the direction of the resistive force may not be arbitrarily controlled as said direction is necessarily in a direction opposite the motion of the movable element.

Actuator: As used herein, the term "actuator" is understood to mean a device capable of changing a dimension (e.g., extending or compressing its length) in response to a control signal (e.g., an electrical signal). Certain (but not all) types of actuators may include a movable element that moves in a first direction (e.g., upwards), relative to an actuator housing, during extension of the actuator and in a second direction (e.g., downwards), relative to the actuator housing, during compression of the actuator. In certain implementations, an actuator may be capable of exerting a force on the movable element in the direction of motion of the movable element, thereby actively facilitating said motion. In certain implementations, an actuator (e.g., an electro-hydraulic actuator) may also be capable of exerting a force on the movable element opposite the direction of motion of the movable element. In certain implementations, an actuator may be capable of exerting a force on the movable element even in the absence of motion of the movable element. In certain implementations, an actuator may function as a passive or semi-active damper. In certain implementations, an actuator may be capable of operating in at least three quadrants of a force-velocity diagram. In certain implementations, an actuator may be capable of operating in all four quadrants of a force-velocity diagram. An electro-hydraulic actuator is understood to mean an actuator that includes an electric motor, a hydraulic pump, and the movable element (e.g., a piston). Other types of actuators may include an electro-mechanical actuator (e.g. a ball screw), and an electrical actuator (e.g. a linear motor).

Suspension system: A suspension system of a vehicle is understood to mean a set of components that couple a wheel assembly of a vehicle to the vehicle body. A suspension system commonly includes a plurality of dampers and/or actuators and one or more springs in parallel and/or in series with one or more dampers or actuators. A passive suspension system is understood to mean a suspension system of a vehicle that incorporates at least one passive damper. A semi-active suspension system is understood to mean a suspension system of a vehicle that incorporates at least one semi-active damper. An active-suspension system is understood to mean a suspension system of a vehicle that incorporates at least one actuator capable of applying a force to change the distance between a first reference point on the wheel assembly and a second reference point on the vehicle body.

Profile: As used herein, the term "profile" is understood to mean either (i) a value, or (ii) a set of values and, optionally, associated timing data. In certain embodiments, a profile may take the form of, for example, a table or array specifying discrete values and a timing information for each value. Alternatively, a profile may take the form of, for example, one or more functions (e.g., sinusoidal waveforms, non-sinusoidal waveforms, non-periodic functions, etc.) defining a set of values as a function of time. For example, a "torque profile" may include a single torque value (e.g., 3 N-m). Alternatively, a torque profile may include a set of torque values along with associated timing data that specifies when each torque value of the set is to be applied. For example, a torque profile may specify 3 N-m for a period of 10 seconds, followed by 10 N-m for a period of 2 seconds. As another example, a torque profile may specify a starting torque of 3 N-m, and a doubling of torque every 10 seconds until a torque of 100 N-m is achieved. Alternatively, a torque profile may define a plurality of torque values as a function (e.g., a sinusoidal function) of time. Likewise, a "velocity profile" may include a velocity value or a set of velocity values and, optionally, associated timing data.

Controller: As used herein, a "controller" is understood to mean one or more components and/or integrated circuits (such as, for example, a processor) along with associated circuitry and/or software that determines, communicates and/or applies an output signal to a target component based on one or more input commands and/or signals.

Motor Controller: As used herein, a "motor controller" is understood to mean a controller capable of applying a modulable signal to a motor, wherein applying the signal to the motor results in (i) a torque being applied by the motor to a component operatively coupled to the motor (e.g., a pump), and/or (ii) rotation of a rotor of the motor.

Command torque: As used herein, the term "command torque" (used interchangeably with "command torque profile") is understood to mean a torque profile that specifies one or more torque values, optionally along with timing data, to apply to a pump or to a rotor of a motor operatively coupled to the pump. In various embodiments, a command torque may be provided by a user, an external controller, or a motor controller.

Command velocity: As used herein, the term "command velocity" (used interchangeably with "command velocity profile") is understood to mean a velocity profile that specifies one or more velocity values, optionally along with timing data, at which to operate a pump and/or a rotor of a motor. In various embodiments, a command velocity may be provided by a user, an external controller, or a motor controller.

Nominal command torque: As used herein, the term "nominal command torque" (used interchangeably with "nominal command torque profile") is understood to mean a command torque profile that does not include a ripple cancellation profile.

Nominal command velocity: As used herein, the term "nominal command velocity" (used interchangeably with "nominal command velocity profile") is understood to mean a command velocity profile that does not include a ripple cancellation profile.

Nominal pressure difference: As used herein, the term "nominal pressure difference" (used interchangeably with "nominal pressure differential") is understood to mean the average pressure difference across a pump (e.g., a pressure of fluid discharged by the pump as compared to a pressure of fluid input to the pump) being operated according to a nominal command torque or nominal command velocity, where the average may be taken over a duration of time necessary for at least one of the rotatable elements of the pump to complete a full rotation.

Nominal Pressure: As used herein, the term "nominal pressure" is understood to mean the average pressure observed at a point in a hydraulic circuit comprising a pump, said pump being operated according to a nominal command torque or nominal command velocity, where the average may be taken over a duration of time necessary for at least one of the rotatable elements of the pump to complete a full rotation.

Nominal flow rate: As used herein, the term "nominal flow rate" is understood to mean the average flow rate at a point in a hydraulic circuit comprising a pump, said pump being operated according to a nominal command torque or nominal command velocity, said average taken over a duration of time necessary for at least one of the rotatable elements of the pump to complete at least one full rotation. In certain embodiments, the nominal flow rate may be considered a sum of nominal displacement flow rate (i.e., the average displacement flow rate taken over the duration of time) and nominal leakage flow rate (i.e., the average leakage flow rate taken over the duration of time).

Instantaneous pressure difference: The pressure difference across a pump at a given time.

Instantaneous pressure: The pressure observed at a point in a hydraulic circuit at a given time.

Instantaneous flow rate: The flow rate across a point in a hydraulic circuit at a given time.

Flow ripple: As used herein, the term "flow ripple" is understood to mean the difference between instantaneous flow rate at a given time and a nominal flow rate. A "magnitude" of flow ripple is understood to mean the absolute value of the numerical difference between the instantaneous flow rate at the given time and the nominal flow rate. A "direction" of ripple is understood to refer to the sign (e.g., negative or positive) of the difference of instantaneous value a given time and the nominal value. For example, when the magnitude of instantaneous flow ripple is less than the nominal flow rate, the direction of flow ripple is said to be negative. Conversely, when the magnitude of instantaneous flow ripple is greater than the nominal flow rate, the direction of flow ripple is said to be positive. As would be understood, in certain embodiments, flow ripple may be considered a sum of displacement flow ripple (i.e., the difference between instantaneous displacement flow at a given time and a nominal displacement flow) and leakage flow ripple (i.e., the difference between instantaneous leakage flow at a given time and a nominal leakage flow).

Pressure Ripple: As used herein, the term "pressure ripple" is understood to mean a difference between instantaneous pressure difference at a given time and a nominal pressure difference, or the difference between instantaneous pressure at a given time and a nominal pressure. A "magnitude" of pressure ripple is understood to mean the absolute value of the numerical difference between the instantaneous pressure difference or instantaneous pressure at the given time and the nominal pressure difference or nominal pressure, respectively. A "direction" of flow ripple is understood to refer to the sign (e.g., negative or positive) of the difference of instantaneous flow rate at a given time and the nominal flow rate and follows conventions similar to that described above for direction of flow ripple.

Ripple: As used herein, the term "ripple" is understood to mean variations in any operating parameter (e.g., pressure, flow, exerted force, etc.) of a hydraulic circuit comprising a pump that periodically modulates around a nominal value during operation of the pump according to a nominal command torque or nominal command velocity. For example, ripple is understood to encompass both flow ripple and pressure ripple. In an electro-hydraulic actuator, ripple may further encompass force ripple.

Frequency of ripple: As used herein, the frequency of a ripple describes the frequency (e.g., the number of occurrences over a given time duration) at which the direction of a ripple (e.g., a flow ripple, a pressure ripple) changes.

Model: As used herein, the term "model" is understood to mean a set of one or more algorithms, functions, rules, and/or logic steps that generates an output (e.g., a profile, a signal) based, in part, on one or more input parameters.

Map: As used herein, the term "map" is understood to mean one or more tables (e.g., a look-up table), arrays (e.g., a one-dimensional array or a multidimensional array), plots (e.g., a two dimensional plot, a three dimensional plot), functions, integers, or any combination or permutation thereof, that relates any parameter (i) to an angular position of a pump or (ii) to an angular position of a rotor of a motor operatively coupled to a pump.

Ripple map: As used herein, the term "ripple map" is understood to mean a map that relates one or more parameters related to ripple in a hydraulic circuit (i) to an angular position of a pump or (ii) to an angular position of a rotor of a motor operatively coupled to a pump. The term ripple map is understood to encompass pressure ripple maps or flow ripple maps (e.g., displacement ripple maps, leakage ripple maps). Ripple maps of any type may be normalized or non-normalized, as the disclosure is not so limited.

Displacement volume gain map: As used herein, the term "displacement volume gain map" is understood to mean a map that relates displacement volume gain (denoted a in the equations herein) to an angular position of a pump or to an angular position of a rotor of a motor operatively coupled to a pump.

Displacement volume map: As used herein, the term "displacement volume map" is understood to mean a map that relates displacement volume of a pump (denoted $Disp_g(O)$) in the equations herein) to an angular position of a pump or to an angular position of a rotor of a motor operatively coupled to a pump.

Displacement ripple map: As used herein, a "displacement ripple map" is understood to mean a map that relates one or more displacement parameters to an angular position of a pump or to an angular position of a rotor of a motor operatively coupled to a pump.

Displacement parameter: As used herein, the term 'displacement parameter' is understood to mean any parameter that may be used in a model to characterize instantaneous displacement flow or instantaneous displacement flow ripple at a given time. Examples of displacement parameters include, for example, displacement volume gain and displacement volume.

Leakage gain map: As used herein, a "leakage gain map" is understood to mean a map that relates leakage gain (denoted β in the equations herein) to an angular position of a pump or to an angular position of a rotor of a motor operatively coupled to a pump. A leakage gain map is a type of leakage ripple map.

Leakage coefficient map: As used herein, a "leakage gain map" is understood to mean a map that relates leakage coefficient (denoted Clg(Θ) in the equations herein) to an angular position of a pump or to an angular position of a rotor of a motor operatively coupled to a pump. A leakage coefficient map is a type of leakage ripple map.

Leakage ripple map: As used herein, the term 'leakage ripple map' is understood to mean a map that relates any leakage parameter to an angular position of a pump or to an angular position of a rotor of a motor operatively coupled to a pump. Leakage ripple maps are understood to encompass, for example, leakage gain maps, leakage coefficient maps, leakage flow maps (i.e., a map that relates leakage flow to an angular position of a rotor of to an angular position of a pump or to an angular position of a rotor of a motor operatively coupled to a pump), and leakage flow ripple maps.

Leakage parameters: As used herein, the term "leakage parameter" is understood to mean any parameter that may be used in a model to characterize instantaneous leakage flow or instantaneous leakage flow ripple at a given time. Examples of leakage parameters include leakage gain and leakage coefficient.

Flow parameters: As used herein, the term "flow parameter" is understood to mean any parameter that may be used in a model to characterize instantaneous flow across a pump, instantaneous flow at a point in a hydraulic circuit comprising a pump, or instantaneous flow ripple at a point in a hydraulic circuit comprising a pump. Flow parameters are understood to encompass, for example, leakage parameters and displacement parameters.

Flow ripple map: As used herein, a "flow ripple map" is understood to mean a map that relates one or more flow parameters to an angular position of a pump or to an angular position of a rotor of a motor operatively coupled to a pump. Flow ripple maps encompass, for example, displacement ripple maps and leakage ripple maps.

Stabilized command velocity profile: As used herein, a "stabilized command velocity profile" is understood to mean a command velocity profile, wherein operating the pump according to the stabilized command velocity profile at least partially attenuates flow ripple as compared to operating the pump according to a corresponding nominal command velocity profile. In certain embodiments, a stabilized command velocity profile may be obtained by modifying the corresponding nominal command velocity profile according to a ripple cancellation velocity profile. In certain embodiments, the mean velocity of a pump operated according to a stabilized command velocity profile and the mean velocity of the pump operated according to the corresponding nominal command velocity profile may be equal.

Stabilized displacement velocity profile: As used herein, a "stabilized displacement velocity profile" is understood to mean a velocity profile, wherein operating the pump according to the stabilized displacement velocity profile results in at least partial cancellation of (e.g., reduction in the magnitude of) displacement flow ripple as compared to operating the pump according to a corresponding nominal command velocity profile.

Stabilized leakage velocity profile: As used herein, a "stabilized leakage velocity profile" is understood to mean a velocity profile, wherein operating the pump according to the stabilized leakage velocity profile results in at least partial cancellation of (e.g., reduction in the magnitude of) leakage flow ripple as compared to operating the pump according to a corresponding nominal command velocity profile.

Ripple cancellation velocity profile: As used herein, the term "ripple cancellation velocity profile" is understood to mean a velocity profile that specifies one or more velocity values, such that modifying a nominal command velocity profile according to the ripple cancellation velocity profile generates a stabilized command profile. The term ripple cancellation velocity profile is understood to encompass leakage-ripple cancellation velocity profiles, displacement-ripple cancellation velocity profiles, and any combination (e.g., a single velocity profile that sums or otherwise combines a leakage-ripple cancellation velocity profile and a displacement-ripple cancellation velocity profile) thereof.

Leakage-ripple cancellation velocity profile: As used herein, a "leakage-ripple cancellation velocity profile" is understood to mean a velocity profile that specifies one or more velocity values, such that modifying a nominal command velocity profile according to the leakage-ripple cancellation velocity profile generates a stabilized leakage velocity profile.

Displacement-ripple cancellation velocity profile: As used herein, a "displacement-ripple cancellation velocity profile" is understood to mean a velocity profile that specifies one or more velocity values, such that modifying a nominal command velocity profile according to the displacement-ripple cancellation velocity profile generates a stabilized displacement velocity profile.

Stabilized command torque profile: As used herein, a "stabilized command torque profile" is understood to mean a command torque profile, wherein operating the pump according to the stabilized command torque profile at least partially attenuates flow ripple as compared to operating the pump according to a corresponding nominal command torque profile. In certain embodiments, a stabilized command torque profile may be obtained by modifying the corresponding nominal command torque profile according to a ripple cancellation torque profile. In certain embodiments, the mean torque applied to a pump operated according to a stabilized command torque profile and the mean torque applied to the pump operated according to the corresponding nominal command torque profile may be equal. The term "stabilized command profile" is understood to encompass both stabilized command velocity profiles and stabilized command torque profiles.

Stabilized displacement torque profile: As used herein, a "stabilized displacement velocity profile" is understood to mean a torque profile, such that operating the pump according to the stabilized displacement torque profile results in at least partial cancellation of (e.g., reduction in the magnitude of) displacement flow ripple as compared to operating the pump according to a corresponding nominal command torque profile.

Stabilized leakage torque profile: As used herein, a "stabilized leakage torque profile" is understood to mean a torque profile, such that operating the pump according to the stabilized leakage torque profile results in at least partial cancellation of (e.g., reduction in the magnitude of) leakage flow ripple as compared to operating the pump according to a corresponding nominal command torque profile.

Ripple cancellation torque profile: As used herein, a "ripple cancellation torque profile" is understood to mean a torque profile that specifies one or more torque values, such that modifying a nominal command torque profile according to the ripple cancellation torque profile generates a stabilized command torque profile. The term ripple cancellation torque profile is understood to encompass leakage-ripple cancellation torque profiles, displacement-ripple cancellation torque profiles, reaction-ripple cancellation torque profiles and any combination (e.g., a single torque profile that sums or otherwise combines values from two of the aforementioned torque profiles) thereof.

Physically attached: As used herein, the term "physically attached to" may encompass, for example, two components which are fastened, attached, bonded, glued, joined, latched, or otherwise secured to each other where the joint formed by attaching two or more components may be capable of transmitting at least an appropriate force under at least certain operating conditions. The term "physically attached" may encompass, for example, any of a permanent attachment (e.g., welded to), a semi-permanent attachment (e.g., via use of a removable fastener such as a nut), a removable attachment (e.g., via use of a latch), a movable attachment (e.g., the first component may be independently moved in at least one direction relative to the second component), a rotatable attachment (e.g., the first component may be rotated relative to the second component), a fixed attachment (e.g., the position of the first component may be effectively fixed relative to the second component), and/or a compliant attachment (e.g., the first component may be attached to the second component via an intermediate compliant element such as, for example, a spring). As a further example, a first component may be physically attached to a second component via one or more intermediate components. For example, in the case of a first component that may be physically attached to a second component that may be physically attached to a third component, it is understood that the first component may be said to be "physically attached to" the third component.

In communication: As the term is used herein, a first component is said to be "in communication" with a second component when the first component is capable of sending and/or receiving electrical power and/or one or more signs, signals, messages, images, sounds, or information of any nature to and/or from a second component. The term "in communication" may encompass, for example, one way communication (e.g., in which a first component is capable of sending information to a second component but not capable of receiving information from the second component) or two way communication (e.g., in which a first component is capable of both sending information to and receiving information from a second component). Components may communicate via, for example, wires or cables (e.g., cables carrying electrical signals, cables carrying optical signals, etc.), may communicate wirelessly (e.g., via transmission of radio waves, microwaves, or other electromagnetic radiation), or may use a combination of wires, cables, and/or wireless communication. As a further example, a first component may be in communication with a second component via one or more intermediate components. For example, in the case of a first component that is in communication with a second component that is in communication with a third component, it is understood that the first component may be said to be in communication with the third component. As used herein, it is understood that the term fluid may encompass, for example, compressible and incompressible fluids and the term fluid communication may encompass, for example, hydraulic and pneumatic communication. As used herein, the term compressible fluid is understood to mean gas or vapor.

Hydraulic circuit: As used herein, the term "hydraulic circuit" is understood to mean a set of two or more components (e.g., pumps, tubes, hoses, pipes, loads, chambers, reservoirs, tanks, valves, orifices, ports, etc.), wherein each component of the set is in fluid communication with at least one other component of the set. The term is understood to encompass both closed hydraulic circuits and open hydraulic circuits. As used herein, the term reservoir is understood to mean a volume capable of receiving fluid from a hydraulic circuit and/or supplying fluid to the hydraulic circuit.

What is claimed is:

1. A pressure-balanced active buffer for mitigating flow ripple in a hydraulic circuit that hydraulically connects a pump and a load, the pressure-balanced active buffer comprising:

a buffer reservoir hydraulically connected to the hydraulic circuit;

a balance reservoir hydraulically connected to the hydraulic circuit;

a piston assembly comprising a first piston with a first surface exposed to hydraulic fluid in the buffer reservoir and a second piston with a second surface exposed to hydraulic fluid in the balance reservoir;

an intermediate chamber, at least partially filled with a compressible fluid, interposed between the first piston and the second piston; and an actuator physically attached to the first piston.

2. The pressure-balanced active buffer of claim 1 comprising:

a buffer fluid channel configured to provide fluid communication between the hydraulic circuit and the buffer reservoir; and a balance fluid channel configured to provide fluid communication between the hydraulic circuit and the balance reservoir.

3. The pressure-balanced active buffer of claim 1 comprising:

an actuator controller in communication with the actuator and configured to determine an actuator cancellation signal based at least in part on a first set of inputs, wherein transmitting the actuator cancellation signal to the actuator causes a dimension of the actuator to change.

4. The pressure-balanced active buffer of claim 3 comprising a non-transitory computer memory in communication with the actuator controller, wherein the memory stores at least one ripple map.

5. The pressure-balanced active buffer of claim 1, wherein the pump is a positive displacement pump comprising an outlet port, wherein the outlet port is in fluid communication with the buffer reservoir and the balance reservoir.

6. The pressure-balanced active buffer of claim 3, comprising:

a positive displacement pump comprising an outlet port, wherein the outlet port is in fluid communication with the buffer reservoir and the balance reservoir;

a motor comprising a rotor operatively coupled to one or more rotatable elements of the positive displacement pump; and a rotary position sensor configured to generate a position signal corresponding to an angular position of (i) the positive displacement pump or (ii) the rotor, wherein the first set of inputs comprises the position signal.

7. The pressure-balanced active buffer of claim 2, wherein the balance fluid channel comprises a low-pass filter.

8. The pressure-balanced active buffer of claim 7, wherein the low-pass filter is selected from the group consisting of a restriction orifice and a Helmholtz resonator.

9. A method for operating a pressure-balanced active buffer, the pressure-balanced active buffer comprising a buffer reservoir, a balance reservoir, a first surface, and a second surface, the method comprising:

receiving, at the buffer reservoir, a first portion of fluid from a hydraulic circuit;

receiving, at the balance reservoir, a second portion of fluid from the hydraulic circuit, wherein the first surface is exposed to the first portion of fluid and the second surface is exposed to the second portion of fluid; and changing a position of the first surface with an actuator, thereby changing a volume of the buffer reservoir.

10. The method of claim 9, wherein the actuator is electrically controlled.

11. The method of claim 9, wherein changing the position of the first surface comprises:

determining a cancellation signal; and applying the cancellation signal to the actuator, wherein the actuator is physically attached to a buffer piston comprising the first surface, wherein applying the cancellation signal to the actuator changes a dimension of the actuator, thereby changing the position of the first surface.

12. The method of claim 11, wherein determining the cancellation signal comprises:

characterizing a first aspect of a ripple at a first point in the hydraulic circuit; and determining, based at least in part on the first aspect, the cancellation signal, wherein the first aspect is at least one of a direction and a magnitude, and wherein the ripple is at least one of a flow ripple and a pressure ripple.

13. The method of claim 12, wherein characterizing the first aspect comprises:

detecting an angular position of at least one of: (i) a positive displacement pump and (ii) a rotor of a motor operatively coupled to one or more rotatable elements of the positive displacement pump; and determining the first aspect based at least in part on the detected angular position.

14. The method of claim 13, wherein determining the first aspect comprises:

accessing a ripple map; and determining the first aspect based at least in part on the detected angular position and the ripple map.

* * * * *